US008657395B2

(12) United States Patent
Masunaga et al.

(10) Patent No.: US 8,657,395 B2
(45) Date of Patent: Feb. 25, 2014

(54) IMAGE FORMING APPARATUS INCLUDING RECORDING HEAD FOR EJECTING LIQUID DROPLETS

(75) Inventors: Suguru Masunaga, Kanagawa (JP); Tetsu Morino, Osaka (JP); Takeyuki Kobayashi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/600,135

(22) Filed: Aug. 30, 2012

(65) Prior Publication Data

US 2013/0057604 A1 Mar. 7, 2013

(30) Foreign Application Priority Data

Sep. 5, 2011 (JP) ..... 2011-193379

(51) Int. Cl.
*B41J 29/38* (2006.01)

(52) U.S. Cl.
USPC ..... 347/6; 347/84; 347/85; 347/7

(58) Field of Classification Search
USPC ..... 347/6, 7, 14, 19, 84–87
See application file for complete search history.

(56) References Cited

U.S. PATENT DOCUMENTS 6,520,630 B1 * 2/2003 Oda et al. ..... 347/85
2011/0164077 A1 7/2011 Masunaga

FOREIGN PATENT DOCUMENTS

JP 6-183027 7/1994
JP 2002-187292 7/2002
JP 2009-023092 2/2009

OTHER PUBLICATIONS

U.S. Appl. No. 13/467,418, filed May 9, 2012, Takeyuki Kobayashi, et al.

* cited by examiner

*Primary Examiner* — Juanita D Jackson
(74) *Attorney, Agent, or Firm* — Cooper & Dunham LLP

(57) ABSTRACT

An image forming apparatus includes a body, a recording head, a sub tank, a carriage, a main tank, a liquid feed unit, a displacement member, first and second detectors, first to third calculation units, a determination unit, and a supply control unit. When the first detector detects the displacement member, the determination unit determines a main scanning position of the carriage at which consumption amount of the liquid is equal to an amount corresponding to a difference calculated by the second unit, based on a relation calculated by the third unit. The control unit causes the feed unit to start supply of the liquid from the main tank to the sub tank when the carriage arrives at the main scanning position, and stop the supply when the liquid is supplied at an amount corresponding to a difference detected by the first unit after the first detector detects the displacement member.

10 Claims, 19 Drawing Sheets

IMAGE FORMING APPARATUS INCLUDING RECORDING HEAD FOR EJECTING LIQUID DROPLETS

CROSS-REFERENCE TO RELATED APPLICATION

This patent application is based on and claims priority pursuant to 35 U.S.C. §119 to Japanese Patent Application No. 2011-193379, filed on Sep. 5, 2011, in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting liquid droplets and a sub tank for supplying liquid to the recording head.

2. Description of the Related Art

Image forming apparatuses are used as printers, facsimile machines, copiers, plotters, or multi-functional devices having two or more of the foregoing capabilities. As one type of image forming apparatus employing a liquid-ejection recording method, an inkjet recording apparatus is known that uses a recording head (liquid ejection head or liquid-droplet ejection head) for ejecting droplets of ink or other liquid.

Such a liquid-ejection type image forming apparatus may have a main tank (also referred to as ink cartridge) and a sub tank (also referred to as head tank or buffer tank). The main tank is removably mounted in an apparatus body to supply ink to the sub tank, and the sub tank supplies ink to the recording head.

The sub tank may have a negative-pressure forming function (mechanism) to create a negative pressure to prevent ink from exuding or dropping from nozzles of the recording head. The sub tank has a negative-pressure forming unit and an air release unit. The negative-pressure forming unit includes a flexible member (film member) to form one face of an ink storage part to store ink and an elastic member to urge the flexible member outward. The air release unit is openably disposed at the sub tank to release the interior of the ink storage part to the atmosphere. Ink is supplied from the ink storage part to the recording head.

The sub tank has a displacement member (also referred to as detection member or detection feeler) to displace with the displacement of the flexible member. When ink is supplied from the main tank to the sub tank with the air release unit of the sub tank opened, i.e., air release filling is performed, the carriage is moved to a predetermined detection position (ink full position) and a driving device of the air release unit disposed at the apparatus body is activated to release the interior of the sub tank to the atmosphere. In such a state, ink filing is started. When a detector disposed at the apparatus body detects the displacement member, the position of the carriage is determined as the ink full position (see JP-2009-023092-A).

In such a case, to allow ink to be replenished and supplied during printing operation, in a case in which the consumption amount of ink during printing is a first threshold value or more, if it is determined based on information associated with the amount of ink supplied from the main tank to the sub tank during printing that the amount of ink supplied is a second threshold value or less, ink is supplied from the main tank to the sub tank. By contrast, if the amount of ink supplied is greater than a second threshold value, ink is not supplied from the main tank to the sub tank.

Alternatively, instead of the above-described configuration, the sub tank may be provided with a detector for detecting the amount of ink remaining in the sub tank to allow ink supply during printing operation (see JP-06-183027-A).

For the above-described configuration in which the sub tank has the displacement member displaceable with the remaining amount of ink in the sub tank to allow detection of an ink full state of the sub tank, when ink is supplied from the main tank to the sub tank, the carriage need be moved to the predetermined ink full position. As a result, when the remaining amount of ink in the sub tank decreases below a threshold value during printing, the printing need be temporarily stopped to perform ink supply operation, thus reducing printing speed.

In such a case, for example, by counting the number of ink droplets ejected from the head, the consumption amount of ink in the sub tank may be calculated to supply ink from the main tank at a supply amount corresponding to the consumption amount. However, for such a configuration, since the ink full position is not accurately detected, insufficient ink supply might cause an excess negative pressure or excessive ink supply might cause an insufficient negative pressure. For this reason, the carriage need be regularly moved to the ink-full detection position to perform the air release filling. As a result, printing operation need be stopped, thus reducing the printing speed.

In addition, it is conceivable to provide, with the carriage, a detector for detecting the remaining amount of ink in the sub tank, a driving device for driving the air release unit of the sub tank, and a member and/or device to control ink supply to the sub tank. However, such a configuration increases the size and weight of the carriage, thus increasing the size of the entire apparatus.

BRIEF SUMMARY

In an aspect of this disclosure, there is provided an image forming apparatus including an apparatus body, a recording head, a sub tank, a carriage, a main tank, a liquid feed unit, a displacement member, a first detector, a second detector, a first calculation unit, a second calculation unit, a third calculation unit, a determination unit, and a supply control unit. The recording head ejects droplets of liquid. The sub tank stores the liquid supplied to the recording head. The carriage mounts the recording head and the sub tank. The main tank stores the liquid supplied to the sub tank. The liquid feed unit supplies the liquid from the main tank to the sub tank. The displacement member is disposed at the sub tank to displace with a remaining amount of the liquid in the sub tank. The first detector is disposed at the carriage to detect the displacement member. The second detector is disposed at the apparatus body to detect the displacement member. The first calculation unit detects and retains a first difference between a first-detector detection position of the displacement member at which the displacement member is detected by the first detector and a liquid full position of the displacement member at which the displacement member is detected by the second detector. The second calculation unit calculates and retains a second difference between the first-detector detection position of the displacement member and a supply start position of the displacement member at which the liquid feed unit starts the liquid from the main tank to the sub tank. The third calculation unit calculates, from image data to be printed, and retains a relation between main scanning position of the carriage and consumption amount of the liquid ejected from the recording head to print the image data. When the first detector detects the displacement member, the determination unit determines a main scanning position of the carriage at which the consumption amount of the liquid ejected from the recording head to print the image data is equal to a liquid consumption amount corresponding to the second difference, based on the relation retained by the third calculation unit. The supply control unit causes the liquid feed unit to start supply of the liquid from the main tank to the sub tank when the carriage arrives at the main scanning position determined by the determination unit during printing of the image data, and stop the supply of the liquid when the liquid is supplied at a supply amount corresponding to the first difference after the first detector detects the displacement member.

In another aspect of this disclosure, there is provided an image forming apparatus including an apparatus body, a recording head, a sub tank, a carriage, a main tank, a liquid feed unit, a displacement member, a first detector, a second detector, and a supply control unit. The recording head ejects droplets of liquid. The sub tank stores the liquid supplied to the recording head. The carriage mounts the recording head and the sub tank. The main tank stores the liquid supplied to the sub tank. The liquid feed unit supplies the liquid from the main tank to the sub tank. The displacement member is disposed at the sub tank to displace with a remaining amount of the liquid in the sub tank. The first detector is disposed at the carriage to detect a first position of the displacement member. The second detector is disposed at the apparatus body to detect a second position of the displacement member at which the remaining amount of the liquid in the sub tank is greater than at the first position of the displacement member. The supply control unit detects and retains a differential supply amount of the liquid corresponding to a displacement amount of the displacement member between the first position detected by the first detector and the second position detected by the second detector. When the liquid is supplied from the main tank to the sub tank without using the second detector, the supply control unit causes the liquid feed unit to supply the liquid to the sub tank at the differential supply amount after the first detector detects the displacement member. The supply control unit includes a liquid ejection amount calculator and a liquid consumption amount calculator. The liquid ejection amount calculator sums up ejection amount of the liquid ejected from the sub tank. The liquid consumption amount calculator calculates a liquid consumption amount in the sub tank by adding a sum of the ejection amount of the liquid ejected from the sub tank. The liquid ejection amount calculator sums up the ejection amount at summation timings set by dividing a moving distance of the carriage in a single direction or a moving time of the carriage into a plurality of distances or time periods. When the liquid consumption amount in the sub tank exceeds a threshold value during supply of the liquid from the main tank to the sub tank without using the second detector, the supply control unit causes the liquid feed unit to start the supply of the liquid from the main tank to the sub tank.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
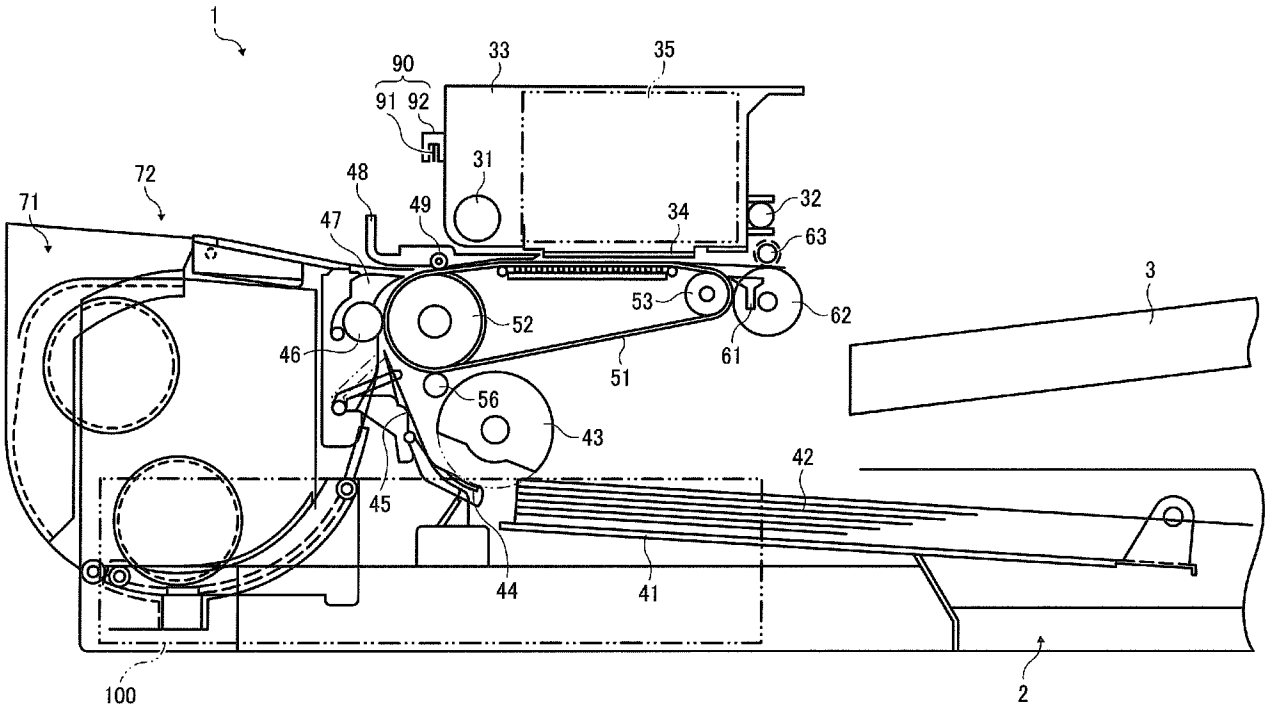
FIG. 1 is a schematic side view of a mechanical section of an image forming apparatus according to a first exemplary embodiment of this disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

In this disclosure, the term "sheet" used herein is not limited to a sheet of paper but be, e.g., an OHP (overhead projector) sheet, a cloth sheet, a grass sheet, a substrate, or anything on which droplets of ink or other liquid can be adhered. In other words, the term "sheet" is used as a generic term including a recording medium, a recorded medium, a recording sheet, or a recording sheet of paper.

In addition, the term "image forming apparatus" refers to an apparatus that ejects ink or any other liquid on a medium to form an image on the medium. The medium is made of, for example, paper, string, fiber, cloth, leather, metal, plastic, glass, timber, and ceramic The term "image formation", which is used herein as a synonym for "image recording" and "image printing", includes providing not only meaningful images such as characters and figures but meaningless images such as patterns to the medium.

The term "ink", unless specified, is not limited to "ink" in a narrow sense unless specifically distinguished and includes any types of liquid useable for image formation, such as recording liquid, fixing solution, DNA sample, resist, pattern material, and resin.

The term "image" used herein is not limited to a two-dimensional image and includes, for example, an image applied to a three dimensional object and a three dimensional object itself formed as a three-dimensionally molded image.

Referring now to the drawings, wherein like reference numerals designate identical or corresponding parts throughout the several views, exemplary embodiments of the present disclosure are described below.

First, an image forming apparatus according to an exemplary embodiment of this disclosure is described with reference to FIGS. 1 and 2.

FIG. 1 is a side view of an entire configuration of the image forming apparatus. FIG. 2 is a plan view of the image forming apparatus.

In this exemplary embodiment, the image forming apparatus is described as a serial-type inkjet recording apparatus. It is to be noted that the image forming apparatus is not limited to such a serial-type inkjet recording apparatus and may be any other type image forming apparatus.

Figure 2:
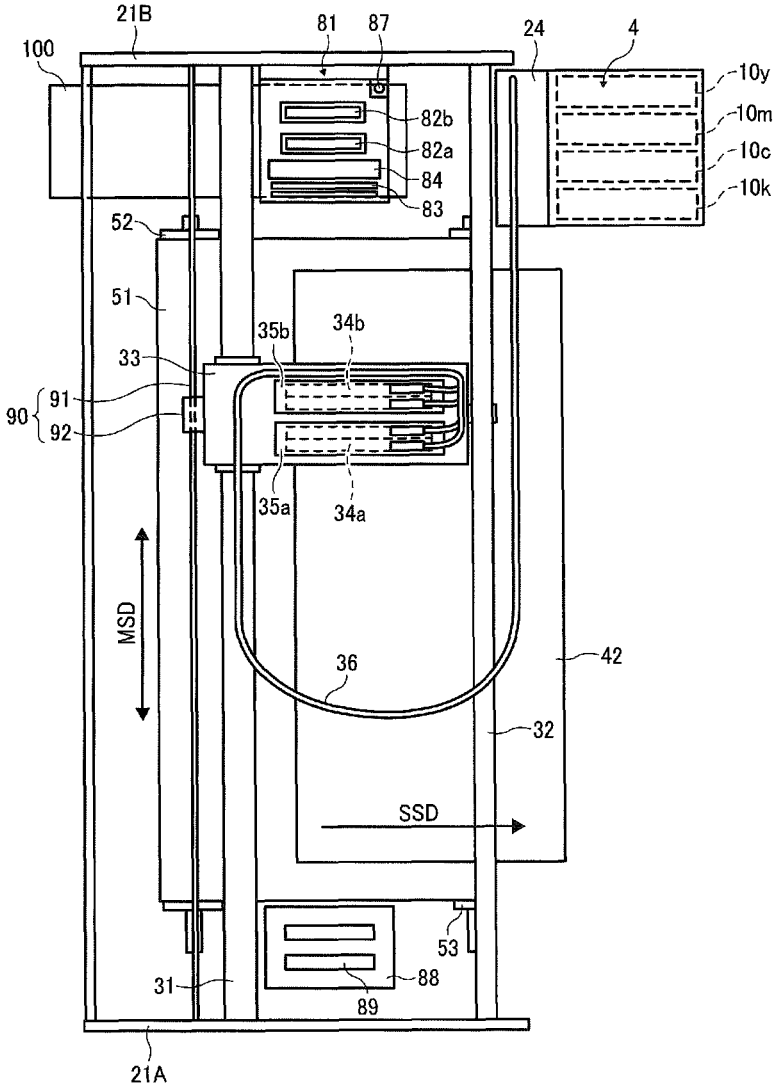
FIG. 2 is a partial plan view of the mechanical section of FIG. 1.

In the image forming apparatus, a carriage 33 is supported by a main guide rod 31 and a sub guide rod 32 so as to be slidable in a direction (main scanning direction) indicated by an arrow MSD in FIG. 2. The main guide rod 31 and the sub guide rod 32 serving as guide members extend between a left side plate 21A and a right side plate 21B standing of an apparatus body 1. The carriage 33 is reciprocally moved for scanning in the main scanning direction MSD by a main scanning motor via a timing belt.

The carriage 33 mounts recording heads 34*a* and 34*b* (collectively referred to as "recording heads 34" unless distinguished) formed with liquid ejection heads for ejecting ink droplets of different colors, e.g., yellow (Y), cyan (C), magenta (M), and black (K). The recording heads 34*a* and 34*b* are mounted on the carriage 33 so that nozzle rows, each of which includes multiple nozzles, are arranged in parallel to a direction (sub scanning direction) perpendicular to the main scanning direction and ink droplets are ejected downward from the nozzles.

Each of the recording heads 34 has two nozzle rows. For example, one of the nozzles rows of the recording head 34*a* ejects liquid droplets of black (K) and the other ejects liquid droplets of cyan (C). In addition, one of the nozzles rows of the recording head 34*b* ejects liquid droplets of magenta (M) and the other ejects liquid droplets of yellow (Y).

The carriage 33 mounts sub tanks 35*a* and 35*b* (collectively referred to as "sub tanks 35" unless distinguished) to supply the respective color inks to the corresponding nozzle rows. A pump unit 24 supplies (replenishes) the respective color inks from ink cartridges 10*y*, 10*m*, 10*c*, and 10*k* removably mountable in a cartridge mount portion 4 to the sub tanks 35 via supply tubes 36 dedicated for the respective color inks.

An encoder scale 91 is disposed so as to extend along the main scanning direction MSD of the carriage 33. The carriage 33 mounts an encoder sensor 92 to read the encoder scale 91. The encoder scale 91 and the encoder sensor 92 form a linear encoder 90. The main scanning position (carriage position) and movement amount of the carriage 33 are detected by detection signals of the linear encoder 90.

The image forming apparatus further includes a sheet feed section to feed sheets 42 stacked on a sheet stack portion (platen) 41 of a sheet feed tray 2. The sheet feed section further includes a sheet feed roller 43 and a separation pad 44. The sheet feed roller 43 has a substantially half moon shape to separate the sheets 42 from the sheet stack portion 41 and feed the sheets 42 sheet by sheet. The separation pad 44 made of a material of a high friction coefficient is disposed opposing the sheet feed roller 43 and urged toward the sheet feed roller 43.

To feed the sheets 42 from the sheet feed section to a position below the recording heads 34, the image forming apparatus includes a first guide member 45 to guide the sheet 42, a counter roller 46, a conveyance guide member 47, a pressing member 48 including a front-end pressing roller 49, and a conveyance belt 51 to attract the sheet 42 thereon by static electricity and convey the sheet 42 to a position opposing the recording heads 34.

The conveyance belt 51 is an endless belt that is looped between a conveyance roller 52 and a tension roller 53 so as to circulate in a belt conveyance direction (sub-scanning direction indicated by an arrow SSD in FIG. 2). The image forming apparatus also has a charging roller 56 serving as a charger to charge the surface of the conveyance belt 51. The charging roller 56 is disposed so as to contact an outer surface of the conveyance belt 51 and rotate with the circulation of the conveyance belt 51. The conveyance roller 52 is rotated by a sub scanning motor via, e.g., a timing belt, so that the conveyance belt 51 circulates in the belt conveyance direction.

The image forming apparatus further includes a sheet output section that outputs the sheet 42 on which an image has been formed by the recording heads 34. The sheet output section includes a separation claw 61 to separate the sheet 42 from the conveyance belt 51, a first output roller 62, a spur 63 serving as a second output roller, and a sheet output tray 3 disposed at a position lower than the first output roller 62.

A duplex unit 71 is detachably mounted on a rear face portion of the apparatus body 1. When the conveyance belt 51 rotates in reverse to return the sheet 42, the duplex unit 71 receives the sheet 42. Then the duplex unit 71 reverses and feeds the sheet 42 to a nipping portion between the counter roller 46 and the conveyance belt 51. A manual-feed tray 72 is formed at an upper face of the duplex unit 71.

As illustrated in FIG. 2, a maintenance device (maintenance and recovery device) 81 is disposed in a non-printing area (non-recording area) at one end in the main scanning direction of the carriage 33. The maintenance device 81 maintains and recovers nozzle conditions of the recording heads 34. The maintenance device 81 includes caps 82*a* and 82*b* (hereinafter collectively referred to as "caps 82" unless distinguished) to cap the nozzle faces of the recording heads 34, a wiping member (wiper blade) 83 to wipe the nozzle faces of the recording heads 34, a first dummy-ejection receptacle 84 to receive liquid droplets ejected by dummy ejection in which liquid droplets not contributing to image recording are ejected to remove increased-viscosity recording liquid, and a carriage lock 87 to lock the carriage 33. Below the maintenance device 81, a waste liquid tank 100 is removably mounted to the apparatus body 1 to store waste ink or liquid discharged by the maintenance and recovery operation.

As illustrated in FIG. 2, a second dummy ejection receptacle 88 is disposed at a non-printing area on the opposite end in the main scanning direction of the carriage 33. The second dummy ejection receptacle 88 receives liquid droplets ejected, e.g., during recording (image forming) operation by dummy ejection in which liquid droplets not contributing to image recording are ejected to remove increased-viscosity recording liquid. The second dummy ejection receptacle 88 has openings 89 arranged in parallel to the nozzle rows of the recording heads 34.

In the image forming apparatus having the above-described configuration, the sheet 42 is separated sheet by sheet from the sheet feed tray 2, fed in a substantially vertically upward direction, guided along the first guide member 45, and conveyed while being sandwiched between the conveyance belt 51 and the counter roller 46. Further, the front end of the sheet 42 is guided by the conveyance guide member 47 and pressed against the conveyance belt 51 by the front-end pressing roller 49 to turn the transport direction of the sheet 42 by substantially 90°.

At this time, positive and negative voltages are alternately supplied to the charging roller 56 so that plus outputs and minus outputs to the charging roller 56 are alternately repeated. As a result, the conveyance belt 51 is charged in an alternating voltage pattern, that is, so that positively-charged areas and negatively-charged areas are alternately repeated at a certain width in the sub-scanning direction SSD, i.e., the belt conveyance direction. When the sheet 42 is fed onto the conveyance belt 51 alternately charged with positive and negative charges, the sheet 42 is attracted on the conveyance belt 51 and conveyed in the sub scanning direction by the circulation of the conveyance belt 51.

By driving the recording heads 34 in accordance with image signals while moving the carriage 33, ink droplets are ejected onto the sheet 42, which is stopped below the recording heads 34, to form one line of a desired image. Then, the sheet 42 is fed by a certain distance to prepare for the next operation to record another line of the image. Receiving a recording end signal or a signal indicating that the rear end of the sheet 42 has arrived at the recording area, the recording operation finishes and the sheet 42 is output to the sheet output tray 3.

To perform maintenance and recovery operation on the nozzles of the recording heads 34, the carriage 33 is moved to a home position at which the carriage 33 opposes the maintenance device 81. Then, the maintenance-and-recovery operation, such as nozzle sucking operation for sucking ink from nozzles with the nozzle faces of the recording heads 34 capped with the caps 82 and/or dummy ejection for ejecting liquid droplets not contributed to image formation, is performed, thus allowing image formation with stable droplet ejection.

Next, an example of the sub tank 35 is described with reference to FIGS. 3 and 4.

Figure 3:
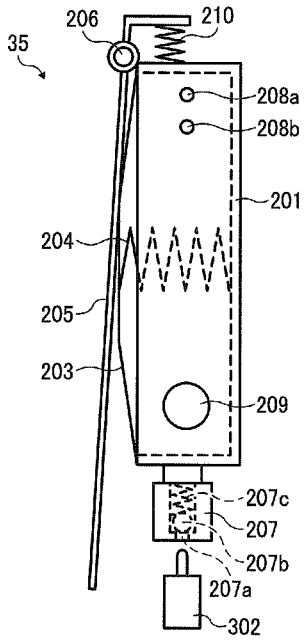
FIG. 3 is a schematic plan view of an example of a sub tank of the image forming apparatus.

FIG. 3 is a schematic plan view of the sub tank 35 corresponding to one nozzle row. FIG. 4 is a schematic front view of the sub tank 35 of FIG. 3.

The sub tank 35 has a tank case 201 forming an ink accommodation part to accommodate ink and having an opening at one side. The opening of the tank case 201 is sealed with a flexible film 203 serving as a flexible member, and a spring 204 serving as an elastic member is disposed in the tank case 201 to constantly urge the flexible film 203 outward. Thus, the outward urging force of the spring 204 acts on the flexible film 203 of the tank case 201. As a result, the remaining amount of ink in the ink accommodation part 202 of the tank case 201 decreases, thus creating negative pressure.

At the exterior of the tank case 201, a displacement member (hereinafter, may also be referred to as simply "feeler") 205 formed with a feeler having one end pivotably supported by a support shaft 206 is fixed on the flexible film 203 by, e.g., adhesive. The displacement member 205 is urged toward the tank case 201 by a spring 210 and displaces with movement of the flexible film 203. By detecting the displacement member 205 with, e.g., a second detector (second sensor) 301 mounted on the carriage 33 or a first detector (first sensor) 251 disposed at the apparatus body 1, the remaining amount of ink or negative pressure in the sub tank 35 can be detected.

A supply port portion 209 is disposed at an upper portion of the tank case 201 and connected to the supply tube 36 to supply ink from the ink cartridge 10. At one side of the tank case 201, an air release unit 207 is disposed to release the interior of the sub tank 35 to the atmosphere. The air release unit 207 includes an air release passage 207*a* communicating with the interior of the sub tank 35, a valve body 207*b* to open and close the air release passage 207*a*, and a spring 207*c* to urge the valve body 207*b* into a closed state. An air release solenoid 302 is disposed at the apparatus body 1, and the valve body 207*b* is pushed by the air release solenoid 302 to open the air release passage 207*a*, thus causing the interior of the head tank 35 to be opened to the atmosphere (in other words, causing the interior of the head tank 35 to communicate with the atmosphere).

Electrode pins 208*a* and 208*b* are mounted in the sub tank 35 to detect the height of the liquid level of ink in the sub tank 35. Since ink has conductivity, when ink reaches the electrode pins 208*a* and 208*b*, electric current flows between the electrode pins 208*a* and 208*b* and the resistance values of the electrode pins 208*a* and 208*b* change. Such a configuration can detect that the liquid level of ink has decreased to a threshold level or lower, i.e., the amount of air in the sub tank 35 has increased to a threshold amount or more.

Figure 5:
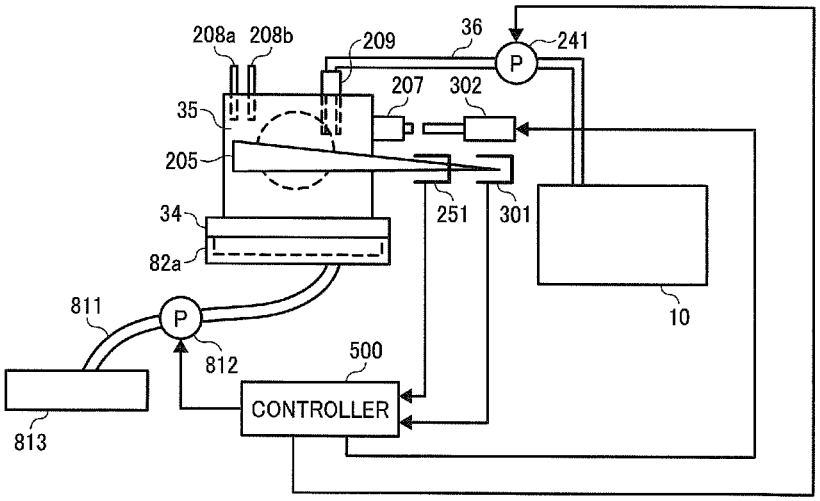
FIG. 5 is a schematic view of an ink supply-and-discharge system of the image forming apparatus.

Next, an ink supply-and-discharge system of the image forming apparatus is described with reference to FIG. 5.

A liquid feed pump 241 serving as a liquid feed unit of the supply pump unit 24 supplies ink from the ink cartridge 10 (hereinafter, main tank 10) to the sub tank 35 via the supply tube 36. The liquid feed pump 241 is a bidirectional pump, e.g., a tube pump, capable of supplying ink from the ink cartridge 10 to the sub tank 35 and returning ink from the sub tank 35 to the ink cartridge 10.

The maintenance device 81, as described above, has the cap 82*a* to cover the nozzle face of the recording head 34 and a suction pump 812 connected to the cap 82*a*. The suction pump 812 is driven with the nozzle face capped with the cap 82*a* to suck ink from the nozzles via a suction tube 811, thus allowing ink to be sucked from the sub tank 35. Waste ink sucked from the sub tank 35 is discharged to a waste liquid tank 813.

The air release solenoid 302 serving as a pressing member to open and close the air release unit 207 of the sub tank 35 is disposed at the apparatus body 1. By activating the air release solenoid 302, the air release unit 207 can be opened.

At the carriage 33 is mounted the first sensor 251 that is an optical sensor serving as the first detector to detect the displacement member 205. At the apparatus body 1 is disposed the second sensor 301 that is an optical sensor serving as the second detector to detect the displacement member 205. As described below, ink supply operation for supplying ink to the sub tank 35 is controlled based on detection results of the first sensor 251 and the second sensor 301.

The driving control of the liquid feed pump 241, the air release solenoid 302, and the suction pump 812 and the ink supply operation according to exemplary embodiments of this disclosure are performed by the controller 500.

Next, an outline of the controller of the image forming apparatus is described with reference to FIG. 6.

Figure 6:
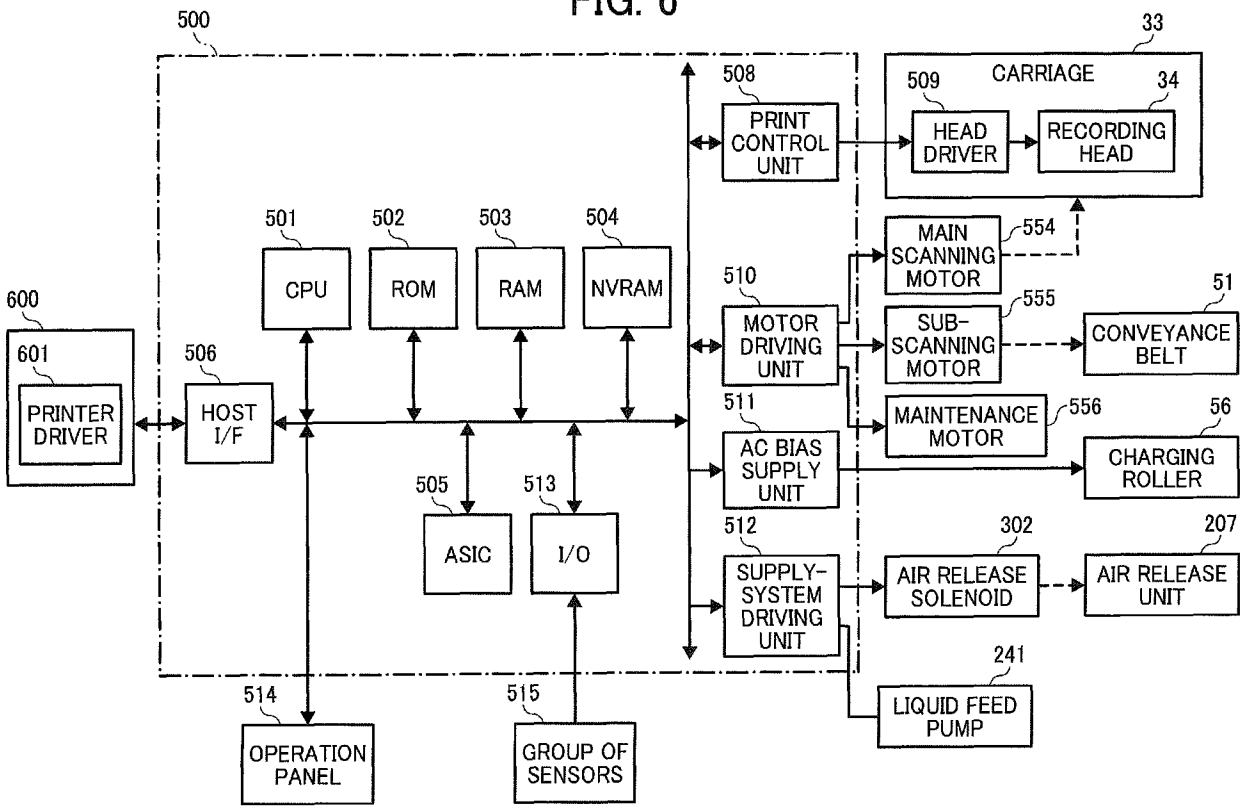
FIG. 6 is a schematic block diagram of a controller of the image forming apparatus.

FIG. 6 is a block diagram of the controller 500 of the image forming apparatus.

The controller 500 includes a central processing unit (CPU) 501*a* read-only memory (ROM) 502, a random access memory (RAM) 503, a non-volatile random access memory (NVRAM) 504, and an application-specific integrated circuit (ASIC) 505. The CPU 501 manages the control of the entire image forming apparatus and serves as various control units including a supply control unit according to exemplary embodiments of this disclosure. The ROM 502 stores programs executed by the CPU 501 and other fixed data, and the RAM 503 temporarily stores image data and other data. The NVRAM 504 is a rewritable memory capable of retaining data even when the apparatus is powered off. The ASIC 505 processes various signals on image data, performs sorting or other image processing, and processes input and output signals to control the entire apparatus.

The controller 500 also includes a print control unit 508, a head driver (driver integrated circuit) 509, a main scanning motor 554, a sub-scanning motor 555, a motor driving unit 510, an alternating current (AC) bias supply unit 511, and a supply-system driving unit 512. The print control unit 508 includes a data transmitter and a driving signal generator to drive and control the recording heads 34 according to print data. The head driver 509 drives the recording heads 34 mounted on the carriage 33. The motor driving unit 510 drives the main scanning motor 554 to move the carriage 33 for scanning, drives the sub-scanning motor 555 to circulate the conveyance belt 51, and drives the maintenance motor 556 of the maintenance device 81. The AC bias supply unit 511 supplies AC bias to the charging roller 56. The supply-system driving unit 512 drives the liquid feed pump 241 and the air release solenoid 302 disposed at the apparatus body 1 to open and close the air release unit 207 of the sub tank 35.

The controller 500 is connected to an operation panel 514 for inputting and displaying information necessary to the image forming apparatus.

The controller 500 includes a host interface (UF) 506 for transmitting and receiving data and signals to and from a host 600, such as an information processing device (e.g., personal computer), image reading device (e.g., image scanner), or imaging device (e.g., digital camera), via a cable or network.

The CPU 501 of the controller 500 reads and analyzes print data stored in a reception buffer of the I/F 506, performs desired image processing, data sorting, or other processing with the ASIC 505, and transfers image data to the head driver 509. Dot-pattern data for image output may be created by a printer driver 601 of the host 600.

The print control unit 508 transfers the above-described image data as serial data and outputs to the head driver 509, for example, transfer clock signals, latch signals, and control signals required for the transfer of image data and determination of the transfer. In addition, the print control unit 508 has the driving signal generator including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image line recorded by the recording heads 34, the head driver 509 selects driving pulses forming driving signals transmitted from the print control unit 508 and applies the selected driving pulses to driving elements (e.g., piezoelectric elements) to drive the recording heads 34. At this time, the driving elements serve as pressure generators to generate energy for ejecting liquid droplets from the recording heads 34. At this time, by selecting a part or all of the driving pulses forming the driving signals, the recording heads 34 can selectively eject different sizes of droplets, e.g., large droplets, medium droplets, and small droplets to form different sizes of dots on a recording medium.

An input/output (I/O) unit 513 obtains information from a group of sensors 515 mounted in the image forming apparatus, extracts information required for controlling printing operation, and controls the print control unit 508, the motor driving unit 510, the AC bias supply unit 511, and ink supply to the sub tanks 35 based on the extracted information.

Besides the first sensor 251, the second sensor 301, and the detection electrode pins 208*a* and 208*b*, the group of sensors 515 includes, for example, an optical sensor to detect the position of the sheet of recording media, a thermistor (environment temperature and/or humidity sensor) to monitor temperature and/or humidity in the apparatus, a voltage sensor to monitor the voltage of the charged belt, and an interlock switch to detect the opening and closing of a cover. The I/O unit 513 is capable of processing various types of information transmitted from the group of sensors.

Next, negative pressure formation of the sub tank 35 in the image forming apparatus is described with reference to FIG. 7.

Figure 7:
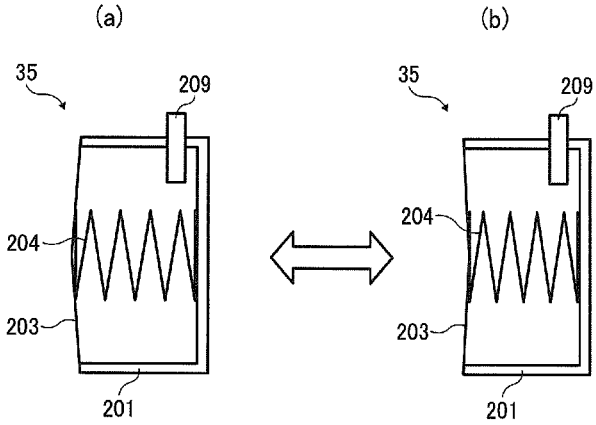
FIG. 7 is a schematic view of the sub tank in negative-pressure forming operation.

As illustrated in (a) of FIG. 7, after ink is supplied from the main tank 10 to the sub tank 35, ink is sucked from the sub tank 35 in the above-described way or the recording head 34 is driven to eject droplets (perform dummy ejection, i.e., eject liquid droplets not contributing to image formation), thus reducing the amount of ink in the sub tank 35. As a result, as illustrated in (b) of FIG. 7, the flexible film 203 deforms inward against the urging force of the spring 204. Thus, the urging force of the spring 204 creates a negative pressure in the sub tank 35

In addition, when the sub tank 35 is sucked by the liquid feed pump 241, the flexible film 203 is drawn inward. As a result, the spring 204 is further compressed, thus increasing the negative pressure.

In such a state, when ink is supplied to the sub tank 35, the flexible film 203 is pushed outward of the sub tank 35. As a result, the spring 204 is expanded, thus reducing the negative pressure.

By repeating such operation, the negative pressure in the sub tank 35 can be controlled within a certain range.

Figure 8:
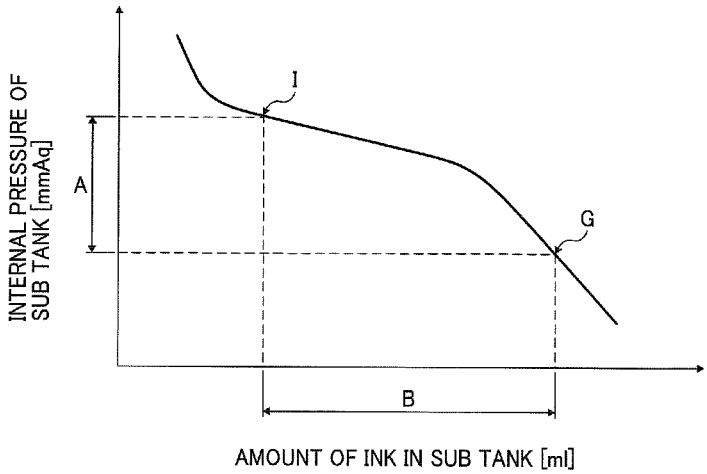
FIG. 8 is a graph chart showing a relation between negative pressure and the amount of ink in the sub tank.

As illustrated in FIG. 8, the negative pressure in the sub tank 35 correlates with the amount of ink in the sub tank 35. The greater the amount of ink in the sub tank 35, the smaller or weaker the negative pressure in the sub tank 35. The smaller the amount of ink in the sub tank 35, the greater or stronger the negative pressure in the sub tank 35. If the negative pressure in the sub tank 35 is too weak, ink would leak from the recording head 34. By contrast, if the negative pressure in the sub tank 35 is too strong, air or dust would enter the sub tank 35 from the recording head 34, thus causing ejection failure.

Hence, in this exemplary embodiment, ink supply to the sub tank 35 is controlled to maintain the amount of ink in the sub tank 35 within a certain range B (ink amount range B) so that the negative pressure in the sub tank 35 is maintained within a certain range A (negative-pressure control range A). As shown in FIG. 8, hereinafter, an amount of ink in the sub tank 35 corresponding to a lower limit (small negative pressure and large amount of ink) of the negative-pressure control range A is represented as "ink full position" (G in FIG. 8) by a displacement position of the displacement member 205 at the lower limit. In addition, an amount of ink in the sub tank 35 corresponding to an upper limit (large negative pressure and small amount of ink) of the negative-pressure control range A is represented as "supply start position" (I in FIG. 8, i.e., a position defined as the remaining amount of ink being zero) by a displacement position of the displacement member 205 at the upper limit.

Next, a method of setting the amount of ink in the sub tank 35 to the ink full position is described with reference to FIG. 9.

Figure 4:
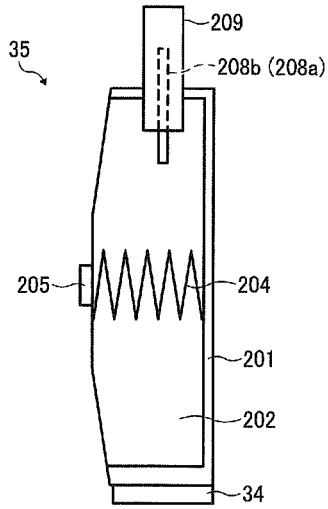
FIG. 4 is a schematic front cross sectional view of the sub tank illustrated in FIG. 3.
Figure 9:
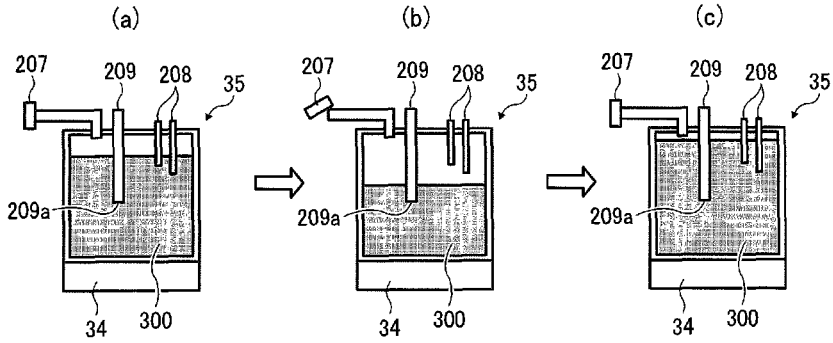
FIG. 9 is a schematic view of the sub tank in which ink is filled up to an ink full position.

In FIG. 9, the sub tank 35 is more schematically shown than FIGS. 3 and 4. From a state illustrated in (a) of FIG. 9, when the air release unit 207 is opened to release the negative pressure in the sub tank 35, the liquid level in the sub tank 35 decreases as illustrated in (b) of FIG. 9. At this time, a supply port 209*a* of the supply port portion 209 is preferably lower than the liquid level. In other words, if, at this time, the supply port 209*a* is higher than the liquid level, air might enter the supply tube 36 via the supply port 209*a* or the supply port portion 209. In the subsequent ink supply, bubbles might be discharged with ink from the supply port 209*a*. In addition, if such ink supply continues, bubbles might be adhered in the air release unit 207, thus causing firm adherence of the valve body or liquid leakage.

After the negative pressure in the sub tank 35 is released and the liquid level decreases, as illustrated in (c) of FIG. 9, ink 300 is supplied. Supply of the ink 300 raises the liquid level and continues till the electrode pins 208*a* and 208*b* detect the liquid level at a certain height, i.e., the ink 300 reaches a certain position in the sub tank 300. When the air release unit 207 is closed and, e.g., a certain amount of ink is sucked and discharged from the sub tank 35, the interior of the sub tank 35 is adjusted to a certain negative pressure value. As described above, the amount of ink in the sub tank 35 is set to the ink full position, thus obtaining the certain negative pressure value.

Next, detection of the displacement amount of the displacement member 205 of the sub tank 35 is described with reference to FIGS. 10 and 11.

Figure 10:
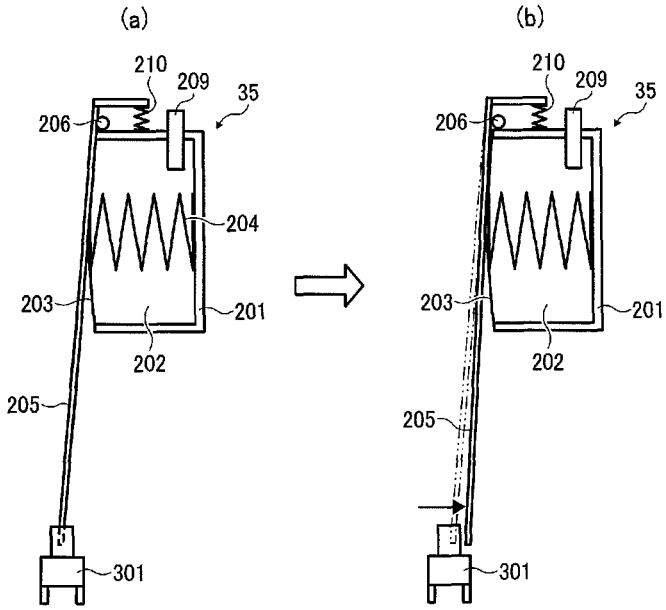
FIG. 10 is a schematic view of the sub tank in which ink is filled up to an ink full position by using only a second sensor.

First, with reference to FIG. 10, an example is described in which the displacement amount is detected with only the second sensor (ink-full detection sensor) 301 disposed at the apparatus body 1.

When, as illustrated in (a) of FIG. 10, the second sensor 301 detects the displacement member 205 of the sub tank 35, a position of the carriage 33 (carriage position obtained by the linear encoder 90) is stored. When, as illustrated in (b) of FIG. 10, the displacement member 205 displaces from the position indicated by a broken line to a position indicated by a solid line, the carriage 33 is moved till the second sensor 301 detects the displacement member 205. Thus, the displacement amount can be obtained as a difference (carriage movement amount) from the carriage position stored.

In a case in which the amount of ink in the sub tank 35 is set to the ink full position, for example, as described above, after the air release unit 207 is released and the interior of the sub tank 35 becomes atmospheric pressure, ink is supplied till the electrode pins 208 detect the liquid level at the certain position. Then, the air release unit 207 is closed. At this time, the carriage 33 is moved to detect the displacement member 205 with the second sensor 301, and a position of the carriage 33 on detection of the displacement member 205 with the second sensor 301 is stored as air release position. By sucking and discharging a certain amount of ink from the recording head 34, a certain amount of ink is sucked from the sub tank 35 to create a negative pressure. At this time, a position of the displacement member 205 is set to be the ink full position. Since the certain amount of ink is sucked from the air release position, the position of the displacement member 205 at the ink full position is placed more inward.

For such a configuration, when ink is replenished to the sub tank 35 up to the ink full position, the displacement amount of the displacement member 205 of the sub tank 35 need be detected. Accordingly, the carriage 33 need be moved to such a position that the second sensor 301 can detect the displacement member 205.

Figure 11:
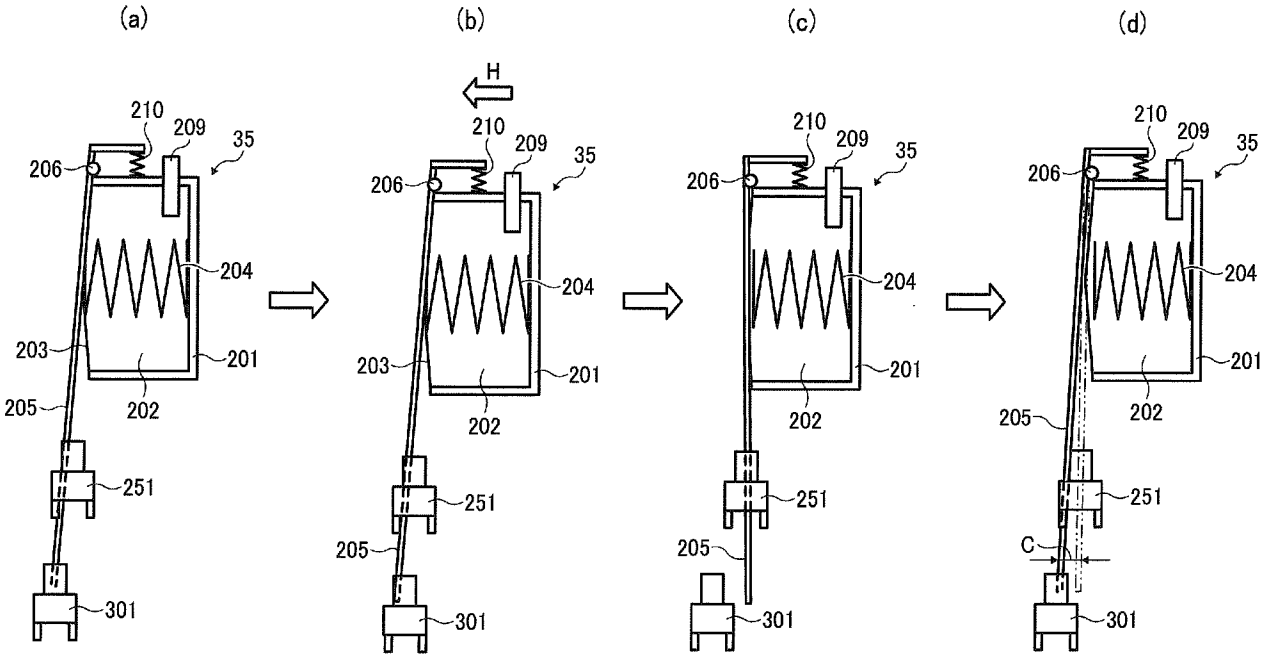
FIG. 11 is a schematic view of the sub tank in which ink is filled up to an ink full position by using a first sensor and the second sensor.

Hence, as illustrated in FIG. 11, in this exemplary embodiment, besides the second sensor 301 disposed at the apparatus body 1, the first sensor 251 is disposed at the carriage 33 to detect the displacement member 205 of the sub tank 35.

That is, a position of the displacement member 205 detected by the second sensor 301 of the apparatus body 1 is referred to as second position, and the second position is defined as the ink full position. In addition, a position of the displacement member 205 detected by the first sensor 251 of the carriage 33 is referred to as first position, and the remaining amount of ink in the sub tank 35 is smaller at the first position than the second position.

In other words, in this exemplary embodiment, the first detector (first sensor) 251 is disposed at the carriage 33 to detect that the displacement member 205 is placed at the first position. The second detector (second sensor) 301 is disposed at the apparatus body 1 to detect that, when ink is replenished from the main tank 10 to the sub tank 35 with the carriage 33 stopped at a certain detection position (ink-full detection position), the displacement member 205 is placed at the second position (ink full position). The first position is set to be a position at which the remaining amount of ink in the sub tank 35 is smaller than at the second position.

When the amount of ink in the sub tank 35 is set to the ink full position (ink is replenished till ink reaches the ink full position), the carriage 33 is moved from the air release position illustrated in (a) of FIG. 11 at which the displacement member 205 is detected by the second sensor 301 to the ink-full detection position in a direction indicated by an arrow H in (b) of FIG. 11. Then, as illustrated in (c) of FIG. 11, the liquid feed pump 241 is driven for reverse rotation till the displacement member 205 passes a position at which the displacement member 205 is detected with the first sensor 251. After the sub tank 35 is sucked toward the main tank 10, the liquid feed pump 241 is driven for forward rotation to supply (send) ink from the main tank 10 to the sub tank 35. When the second sensor 301 detects the displacement member 205 (the displacement member 205 arrives at the ink full position) as illustrated in (d) of FIG. 11, ink supply is stopped.

Here, by detecting a liquid feed amount of the liquid feed pump 241 from when the first sensor 251 detects the displacement member 205 to when the second sensor 301 detects the displacement member 205 at the ink full position, a displacement amount C of the displacement member 205 (flexible film 203) from the position detected by the first sensor 251 to the position detected by the second sensor 301 can be obtained. The supply amount of ink corresponding to the displacement amount C is stored as a differential supply amount.

In such a case, the displacement amount C can be obtained as a period of time (driving time of the liquid feed pump 241) or the number of rotations (the number of rotations to drive the liquid feed pump 241) from when the first sensor 251 detects the displacement member 205 to when the second sensor 301 detects the displacement member 205 at the ink full position.

As described above, by obtaining and storing the differential supply amount (displacement amount C), the following operation can be performed. That is, when it is detected that a certain threshold amount of ink is ejected during scanning of the carriage 33 (the ink consumption amount becomes a threshold value or more), ink can be supplied and replenished from the main tank 10 to the sub tank 35. After the first sensor 251 detects the displacement member 205 of the sub tank 35, the differential supply amount of ink is further supplied to the sub tank 35, thus allowing ink to be supplied up to the ink full position in the sub tank 35.

In such a case, since the detection of the first sensor 251 is position detection, accumulated detection errors in, e.g., the amount of ink ejected and the liquid feed amount of the liquid feed pump 241 are canceled on detection of the first sensor 251. Thus, even during scanning of the carriage 33, ink ejection and ink supply can be repeatedly performed without accumulating detection errors.

By repeating the above-described series of operations, ink can be supplied to the sub tank 35 up to the ink full position without interrupting printing operation, thus enhancing the printing speed or efficiency.

Next, different examples of the arrangement of the first and second sensors is described with reference to FIGS. 12 and 13.

Figure 12:
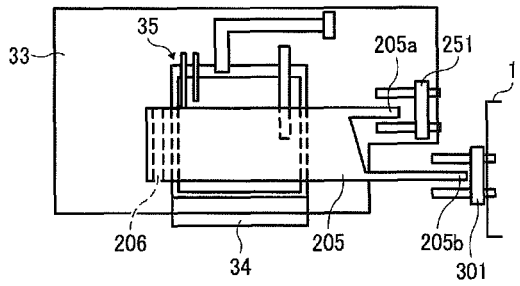
FIG. 12 is an example of arrangement of the first and second sensors.

In an example illustrated in FIG. 12, detected portions 205*a* and 205*b* having different lengths (distances) from the support shaft 206 (pivot axis) are disposed at the displacement member 205 of the sub tank 35. The first sensor 251 of the carriage 33 detects the detected portion 205*a*, and the second sensor 301 disposed at the apparatus body detects the detected portion 205*b*.

Figure 13:
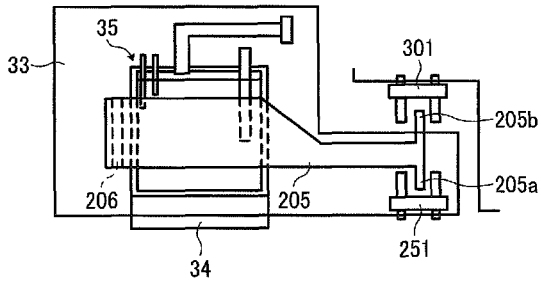
FIG. 13 is another example of arrangement of the first and second sensors.

In an example illustrated in FIG. 13, detected portions 205*a* and 205*b* having the same length (distance) from the support shaft 206 (pivot axis) are disposed at the displacement member 205 of the sub tank 35. The first sensor 251 of the carriage 33 detects the detected portion 205*a*, and the second sensor 301 disposed at the apparatus body detects the detected portion 205*b*.

Figure 14:
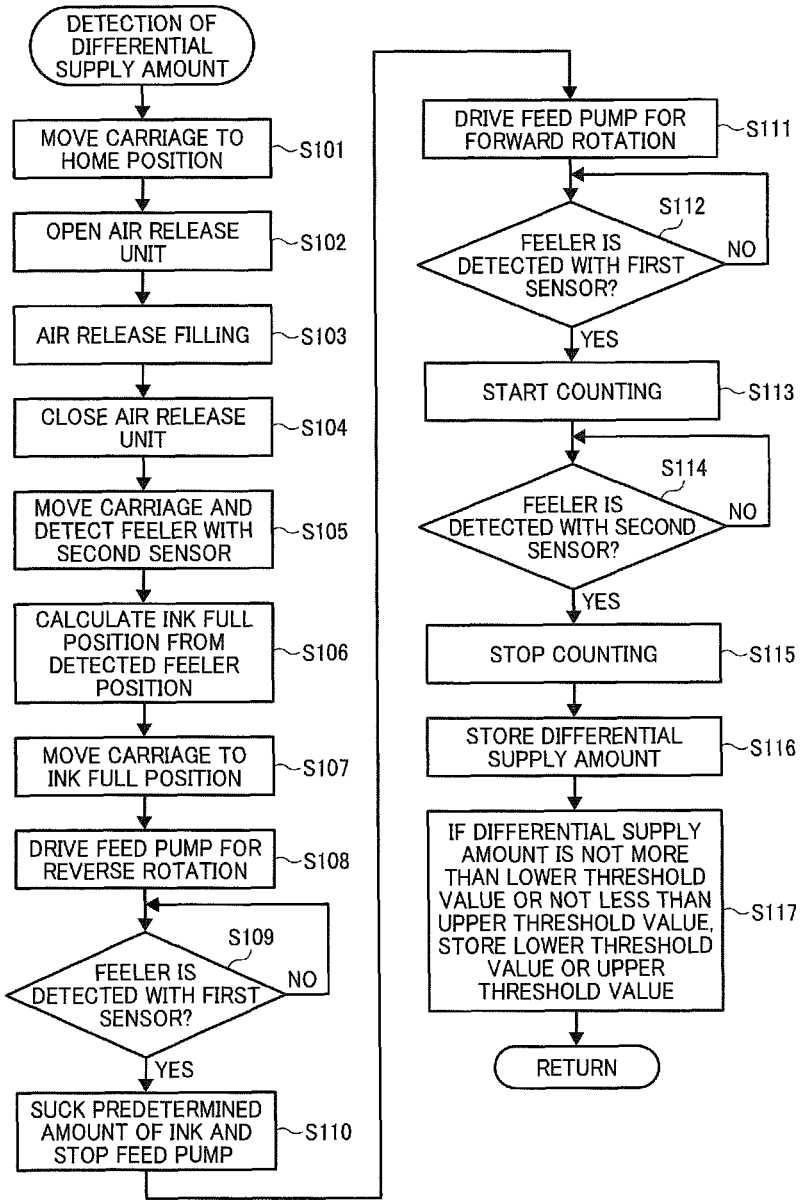
FIG. 14 is a flowchart of a procedure of detection of differential supply amount in the first exemplary embodiment.

Next, a procedure of the calculation (detection) of the differential supply amount in the first exemplary embodiment of the present disclosure is described with reference to FIG. 14.

At S101, the carriage 33 is moved to the home position and the recording head 34 is capped with the cap 82*a*. When the air release unit 207 of the sub tank 35 is opened at S102, at S103 ink is replenished from the main tank 10 to the sub tank 35 while detecting the liquid level of ink in the sub tank 35 by the electrode pins 208*a* and 2086, thus performing air release filling.

At S104, the air release unit 207 of the sub tank 35 is closed. At S105, the carriage 33 is moved while detecting the movement amount of the carriage 33. At S106, the second sensor at the apparatus body detects the displacement member 205 of the sub tank 35, thus calculating the ink full position.

At S107, the carriage 33 is moved to the ink full position, and at S108 the liquid feed pump 241 is driven for reverse rotation to suck the interior of the sub tank 35. The suction of the sub tank 35 is continued till the displacement member 205 of the sub tank 35 passes (is detected by) the first sensor 251. In other words, if the displacement member 205 of the sub tank 35 is detected by the first sensor 251 (YES at S109), at S110 a predetermined amount of ink is sucked and the liquid feed pump 241 is stopped.

At S111, the liquid feed pump 241 is driven for forward rotation to supply ink from the main tank 10 to the sub tank 35 and continues to fill ink in the sub tank 35 till the first sensor 251 detects the displacement member 205 of the sub tank 35. If the first sensor 251 detects the displacement member 205 of the sub tank 35 (YES at S112), at S113 the counting of a liquid feed amount (e.g., driving time or number of rotations) of the liquid feed pump 241 is started. Furthermore, the ink supply is continued till the second sensor 301 detects the displacement member 205 of the sub tank 35. If the second sensor 301 detects the displacement member 205 of the sub tank 35 (YES at S114), the liquid feed pump 241 is stopped and the counting of the liquid feed amount is stopped at S115.

Then, the liquid feed amount (e.g., driving time or number of rotations) of the liquid feed pump 241 from when the first sensor 251 detects the displacement member 205 of the sub tank 35 to when the second sensor 301 detects the displacement member 205 of the sub tank 35 is calculated.

At S116, if the liquid feed amount thus calculated is between a lower threshold value and an upper threshold value, the liquid feed amount is stored as the differential supply amount. At S117, if the liquid feed amount thus calculated is the lower threshold value or less, the lower threshold value is stored as the differential supply amount. By contrast, if the liquid feed amount is the upper threshold value or greater, the upper threshold value is stored as the differential supply amount.

As described above, the carriage 33 is stopped at a position at which the detecting position of the second sensor 301 becomes the ink full position, and liquid is replenished (supplied) from the main tank 10 to the sub tank 35. Then, a differential supply amount (first difference, described below)

corresponding to a displacement amount of the displacement member 205 from when the first sensor 251 detects the displacement member 205 to when the second sensor 301 detects the displacement member 205 is detected and stored.

Figure 15:
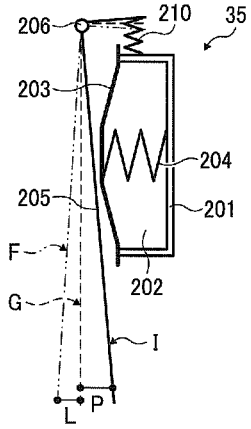
FIG. 15 is a schematic view of a displacement member of the sub tank.

Next, positions of the displacement member of the sub tank are described with reference to FIG. 15.

In a proper range P of negative pressures in the sub tank 35, the displacement member 205 takes the ink full position G (upper threshold value of the amount of ink) at a lowest negative pressure in the range and a supply start position (lower threshold value) I at a highest negative pressure in the range. The air release position F is a position at which the displacement member 205 is more opened relative to the tank case 201 than the ink full position G.

Here, ink is once supplied to the sub tank 35 with the interior of the sub tank 35 released to the atmosphere. Then, by shutting the interior of the sub tank 35 from the atmosphere, a position of the displacement member 205 in the atmospheric state can be detected. From that position, the carriage 33 is moved at a distance corresponding to a designated count L. When ink is drawn back (returned to the main tank 10) till the displacement member 205 is detected, the displacement member 205 takes the ink full position G. Such a configuration is not affected by accumulation of variations among components. In addition, even in a case in which the extension and contraction of the flexible film 203 are affected by temperature and humidity, such a configuration can reset the ink full position, thus allowing a constant negative pressure to be set as the ink full position.

Figure 16:
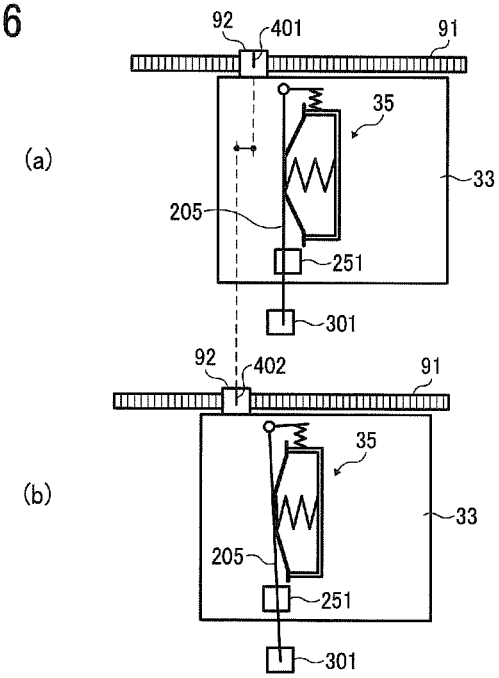
FIG. 16 is a schematic view of the displacement member of the sub tank and a carriage in detecting a first difference.

Next, detection processing of the first difference is described with reference to FIG. 16.

As described above, the image forming apparatus includes the displacement member 205 that displaces with the remaining amount of ink in the sub tank 35, the first sensor 251 formed with, e.g., a transmissive photosensor fixed on the carriage 33 to detect the displacement member 205, and the second sensor 301 fixed at the apparatus body. As illustrated in FIG. 16, a difference between a position (carriage position) 401 of the carriage 33 at the ink full position of the displacement member 205 detected by the second sensor 301 (illustrated in (a) of FIG. 16) and a position (carriage position) 402 of the carriage 33 at a position of the displacement member 205 detected by the first sensor 251 (illustrated in (b) of FIG. 16) is detected and stored as a first difference M1 (S116 and S117 of FIG. 14).

Next, a relation between detection positions of the first sensor and each of the first and second differences is described with reference to FIG. 17.

Figure 17:
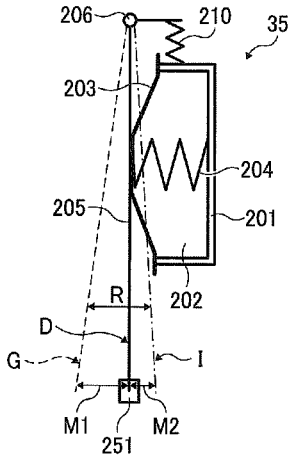
FIG. 17 is a schematic view of a relation between detecting position of the first sensor and each of first and second differences.

In FIG. 17, as described above, the first difference M1 is a difference between the ink full position G and the position (first-sensor detection position) D at which the first sensor 251 detects the displacement member 205. The second difference M2 between the first-sensor detection position D and the supply start position I is a remainder obtained by subtracting the first difference M1 from a range R defined by the supply start position I and the ink full position G. Liquid consumption amounts corresponding to the first difference M1 and the second difference M2 are calculated and stored.

Figure 18:
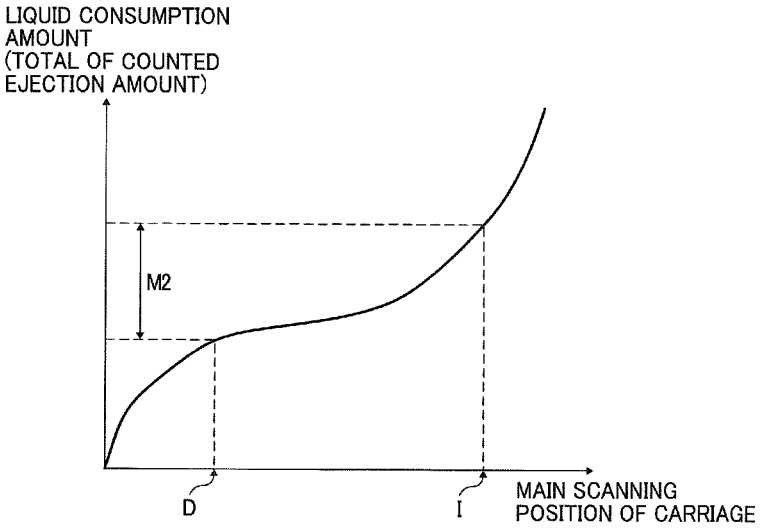
FIG. 18 is a graph chart showing an example of a relation between main scanning position of the carriage and liquid consumption amount.

Next, an example of a relation corresponding to image data between the main scanning position and the liquid consumption amount is described with reference to FIG. 18.

Based on image data to be printed, the amounts of liquid (consumption amounts of liquid or liquid consumption amounts) required till the carriage 33 moves to different main scanning positions during printing of the image data are calculated. The liquid consumption amount can be obtained by multiplying the droplet amount of liquid droplet ejected with the number of droplets ejected.

Hence, when image data to be printed is received from the host 600, by referring to, e.g., a print start position (a position at which ejection of liquid droplets is started) or an edge of a sheet as a reference position, liquid consumption amounts (total of counted ejection amounts) from the reference position to main scanning positions (distances) of the carriage are calculated. Then, data of a graph (or function) of the relation corresponding to image data between the main scanning position of the carriage and the liquid consumption amount as illustrated in FIG. 18 is stored in, e.g., the RAM 503.

Then, a main scanning position of the carriage is calculated at which liquid of an amount corresponding to the second difference M2 is consumed after the first sensor 251 detects the displacement member 205 during printing. The main scanning position calculated is determined as the supply start position I. When the carriage 33 moves to the main scanning position corresponding to the supply start position I determined after the first sensor 251 detects the displacement member 205, liquid (ink) feeding to the sub tank 35 is started.

Figure 19:
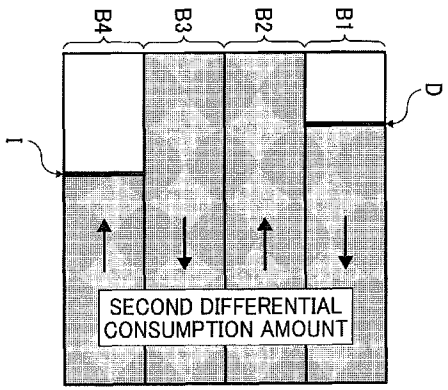
FIG. 19 is a schematic view of ink filling during bidirectional printing.

For example, as illustrated in FIG. 19, when image data received is printed by bidirectional printing, the carriage 33 may print the image data by four scanning operations (first to four scanning B1 to B4 in directions indicated by arrows in FIG. 19). In such a case, when the first sensor 251 detects the displacement member 205 at the first-sensor detection position D in first scanning B1, a main scanning position of the carriage 33 to which ink of an amount (second differential consumption amount) corresponding to the second difference M2 is consumed from the first-sensor detection position D is calculated and determined as the supply start position I. Then, during printing, when the carriage 33 moves to the supply start position I, liquid feeding to the sub tank 35 is started.

For example, as illustrated in FIG. 19, in printing image data by bidirectional printing, when the first sensor 251 detects the displacement member 205 at the first-sensor detection position D in the first scanning B1, it can be determined that the position to which ink of the amount (second differential consumption amount) corresponding to the second difference M2 is consumed from the first-sensor detection position D is a position represented by the supply start position I in the fourth scanning B4. Hence, when the main scanning position of the carriage 33 matches the supply start position I, liquid feeding to the sub tank 35 is started. In FIG. 19, the first scanning B1 and the third scanning B3 are forward-path printing. The second scanning B2 and the fourth scanning B4 are return-path printing.

Thus, when the carriage 33 arrives at the main scanning position (supply start position I) determined after the first sensor 251 detects the displacement member 205 during printing, liquid feeding from the main tank 10 to the sub tank 35 is started. When liquid feeding of a supply amount (differential supply amount) corresponding to the first difference M1 has been performed, liquid feeding is stopped, thus allowing ink to be supplied to the ink full position in the sub tank 35.

Such a configuration can determine the supply start position and start to feed ink to the sub tank 35 without calculating on real time the amount of ink consumed after the first sensor 251 detects the displacement member 205, thus reducing the load of calculation (processing) to the controller 500.

Here, a procedure of ink filling (supply control) performed during printing in this exemplary embodiment is described with reference to FIG. 20.

Figure 20:
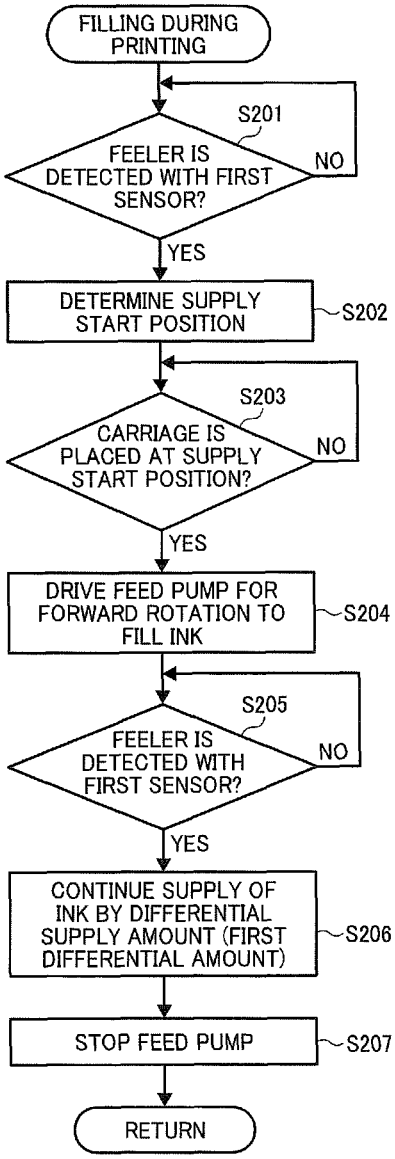
FIG. 20 is a schematic view of a procedure of ink filling during bidirectional printing.

As illustrated in FIG. 20, at S201, it is determined whether or not the first sensor 251 detects the displacement member (feeler) 205. If the first sensor 251 detects the displacement member 205 (YES at S201), at S202 a main scanning position of the carriage 33 at which ink of an amount (ejection-amount count) corresponding to the second difference M2 is consumed after the detection of the displacement member 205 is calculated and determined as the supply start position I. When the main scanning position (movement distance) of the carriage 33 matches the supply start position I (YES at S203), at S204 the liquid feed pump 241 is driven for forward rotation to fill (supply) ink from the main tank 10 to the sub tank 35. At S205, it is determined whether or not the first sensor 251 detects the displacement member (feeler) 205 of the sub tank 35. If the first sensor 251 detects the displacement member 205 of the sub tank 35 (YES at S205), at S206 ink is further filled to the sub tank 35 by the differential supply amount and the liquid feed pump is stopped. As a result, ink is filled up to the ink full position in the sub tank 35.

Thus, during printing, ink can be filled up to the ink full position in the sub tank 35 without returning the carriage 33 to the home position.

Here, a description is given of a reason that the second sensor 301 is also provided at the apparatus body instead of detecting the displacement member 25 with only the first sensor 251 of the carriage 33.

First, the ink full position of the sub tank 35 varies depending on the ambient environment, and the variation cannot be determined by only the first sensor 251 of the carriage 33 because the first sensor 251 can detect only one position at a time. Hence, in this exemplary embodiment, the second sensor 301 is provided at the apparatus body. Moving the carriage 33 allows detection of the air release position and the ink-full detection position varying depending on the environment.

In other words, the distance between two points, i.e., a fixed detection point on the carriage 33 and a detection point movable with movement of the carriage 33 can be detected by the driving time or number of rotations of the liquid feed pump or the counting of the encoder with movement of the carriage, thus allowing the ink supply amount to be controlled in response to the environmental variation.

Alternatively, a sensor or encoder capable of detecting any displacement only from the carriage 33 might be provided at the carriage 33. However, such a configuration increases the cost of the detector and the sizes of the carriage and the apparatus.

In addition, the liquid feed amount (supply or suction amount) of the liquid feed pump may fluctuate due to the environmental variation, deteriorations with time, and/or variation of components. In other words, since the amount of ink supplied by the liquid feed pump till the displacement member is detected by the second sensor 301 of the apparatus body may fluctuate depending on the environment, the amount of ink supplied by the liquid feed pump is preferably confirmed by the positional detection of the second sensor 301. If the ink supply amount of the liquid feed pump is controlled based on only the driving amount of the liquid feed pump without the second sensor 301 of the apparatus body, excessive or insufficient supply might occur and cause a failure. Hence, in this exemplary embodiment, the second sensor 301 is provided to assure the safety of supply control.

Next, a second exemplary embodiment of the present disclosure is described with reference to FIGS. 21 and 22.

Figure 21:
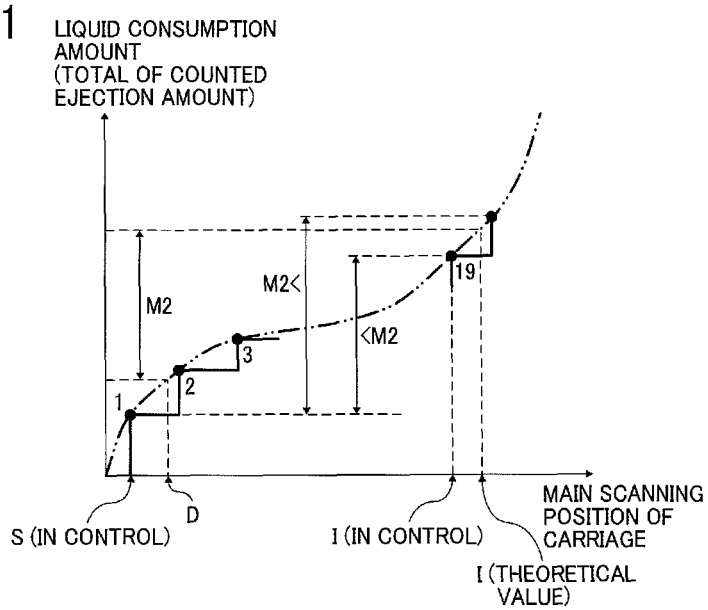
FIG. 21 is a graph chart showing an example of a relation between main scanning position of the carriage and liquid consumption amount in a second exemplary embodiment of this disclosure.

FIG. 21 shows an example of a relation corresponding to image data between the main scanning position of the carriage and the liquid consumption amount in the second exemplary embodiment. FIG. 22 shows an example of ink filling control performed during printing.

First, like the above-described first exemplary embodiment, based on image data to be printed, the amounts of liquid (consumption amounts of liquid or liquid consumption amounts) required till the carriage 33 moves to main scanning positions during printing of the image data are calculated and stored as relational data of the main scanning position of the carriage and the liquid consumption amount.

Figure 22:
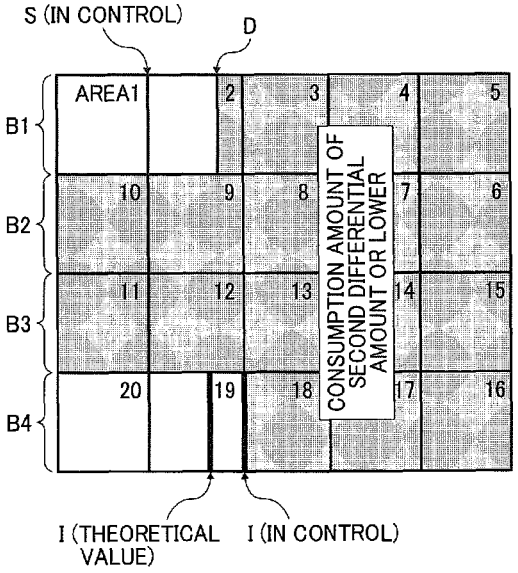
FIG. 22 is a schematic view of ink filling control during bidirectional printing.

At this time, in this exemplary embodiment, for example, as illustrated in FIG. 22, a print region is divided into multiple areas per a certain scanning distance of the carriage or per page. A relation between divided positions of the respective areas and the liquid consumption amounts is calculated and stored. For example, as illustrated in FIG. 22, a sheet is divided into 20 areas (areas 1 to 20). From the area 1, counting (ejection amount count) of the liquid consumption amount (liquid consumption amount to be ejected onto the area 1) is started. Thus, the liquid consumption amount from a count start position of the area 1 to a divided position between the area 1 and the area 2 (indicated by a point 1 of the graph in FIG. 21) is calculated. Likewise, for the area 2, the liquid consumption amount between a count start position S (in control) of the area 2 and a divided position between the area 2 and the area 3 (indicated by a point 2 of the graph in FIG. 21) is calculated. The same calculation is repeated for the subsequent areas. As a result, the liquid consumption amounts at the main scanning positions of the carriage are represented by an imaginary line as indicated by a chain double-dashed line in FIG. 21. Here, as illustrated in solid lines, the liquid consumption amounts varying at the divided positions of the areas are calculated and stored.

As illustrated in FIG. 22, if the first sensor 251 detects the displacement member 205 at the first-sensor detection position D of the area 2, according to calculation, a position (theoretical value in the calculation) at which the liquid consumption amount corresponding to the second difference M2 is consumed) is placed in the area 19. In such a case, at the end position of the area 19 (divided position between the area 19 and the area 20), the total of liquid consumption amount would exceed the consumption amount corresponding to the second difference M2 by a liquid consumption amount of the area 19.

Hence, the end position of the area 18 preceding the area 19 is determined as the supply start position I (in control). When the carriage 33 is placed at a main scanning position corresponding to the supply start position I (divided position between the area 18 and the area 19), liquid feeding to the sub tank 35 is started. Such a configuration can prevent the displacement member 205 from displacing over the second difference M2 (shifting to a position at which excessive negative pressure arises in the sub tank 35).

Such a configuration also facilitates computation of the relation between the main scanning position of the carriage and the liquid consumption amount, reduces the amount of data to be stored, and facilitates calculation of the supply start position after the detection of the displacement member with the first sensor.

Next, another example of divided areas is described with reference to FIGS. 23 and 24.

Figure 23:
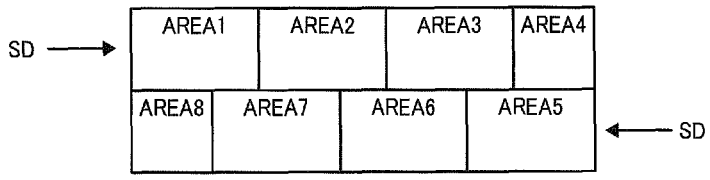
FIG. 23 is a schematic view of an example of divided areas set in ink filling during bidirectional printing.

For the example of FIG. 23, a print region is divided into multiple areas by referring to sheet edge positions as reference points. In FIG. 23, arrows SD indicate moving (scanning) directions of the carriage 33 moved by bidirectional printing. Dividing of the print region as illustrated in FIG. 23 allows the liquid consumption amount to be regularly calculated at the same positions, thus facilitating processing.

Figure 24:
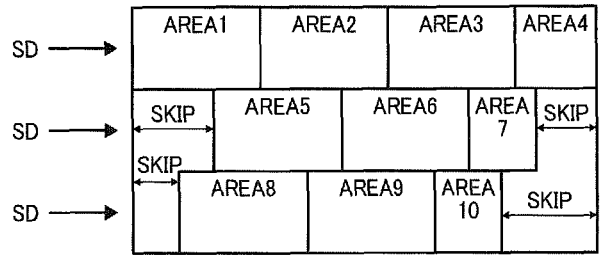
FIG. 24 is a schematic view of another example of divided areas set in ink filling during bidirectional printing.

For the example of FIG. 24, a print region is divided into multiple areas by referring to image start positions as reference points. In FIG. 24, arrows SD indicate a moving (scanning) direction of the carriage 33 moved by unidirectional printing. When a print region is divided into areas as illustrated in FIG. 24, non image areas are omitted from targets of area division and skipped in the calculation, thus reducing the number of divided areas and the amount of data.

The width of divided areas may be a width of single scanning of the carriage. Alternatively, for example, one page may be divided at constant widths, constant times, or constant distances.

Next, a third exemplary embodiment of the present disclosure is described below.

Figure 25:
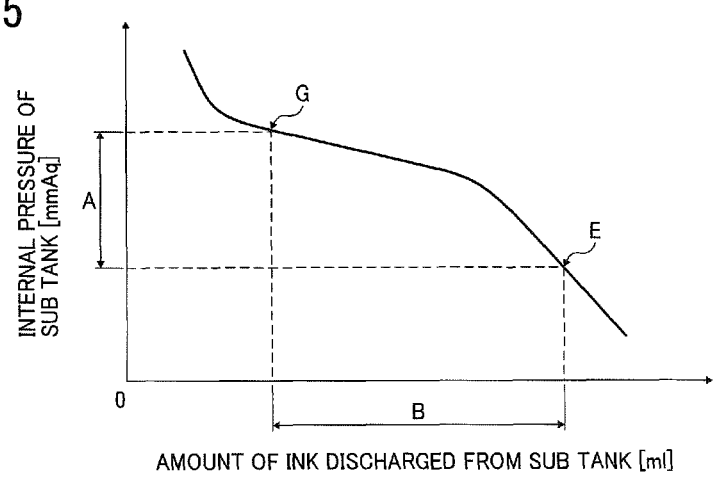
FIG. 25 is a graph chart showing an example of a relation between the amount of ink discharged from a sub tank (liquid consumption amount) and negative pressure in the sub tank in a third exemplary embodiment of this disclosure.

First, an example of the relation between the amount of ink discharged from a sub tank (liquid consumption amount) and the negative pressure in the sub tank is described with reference to FIG. 25.

The negative pressure in the sub tank 35 correlates with the amount of ink in the sub tank 35. The greater the amount of ink in the sub tank 35, the smaller or weaker the negative pressure in the sub tank 35. The smaller the amount of ink in the sub tank 35, the greater or stronger the negative pressure in the sub tank 35. If the negative pressure in the sub tank 35 is too weak, ink would leak from the recording head 34. By contrast, if the negative pressure in the sub tank 35 is too strong, air or dust would enter the sub tank 35 from the recording head 34, thus causing ejection failure.

Hence, in this exemplary embodiment, ink supply to the sub tank 35 is controlled to maintain the amount of ink discharged from the sub tank 35 within a certain range B (discharged ink amount range B) so that the negative pressure in the sub tank 35 is maintained within a certain range A (negative-pressure control range A).

Next, calculation processing of the liquid ejection amount of the head and the liquid consumption amount of the sub tank in this exemplary embodiment is described with reference to FIGS. 26 and 27.

Figure 26:
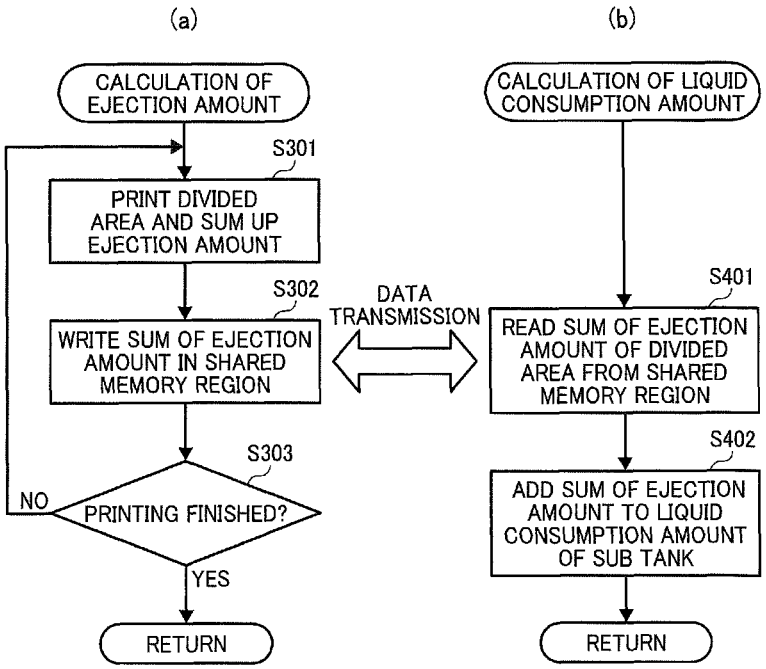
FIG. 26 shows flowcharts of calculation of the liquid ejection amount and calculation of the liquid consumption amount in the third exemplary embodiment.

FIG. 26 shows (a) a procedure of calculation of the liquid ejection amount and (b) a procedure of calculation of the liquid consumption amount. FIG. 27 shows divided areas in this exemplary embodiment.

For the calculation of the liquid ejection amount illustrated in (a) of FIG. 26, when printing is started, at S301 the amount of liquid (droplets) ejected from the recording head 34 onto each divided area (liquid ejection amount) is summed per printing of each divided area.

Figure 27:
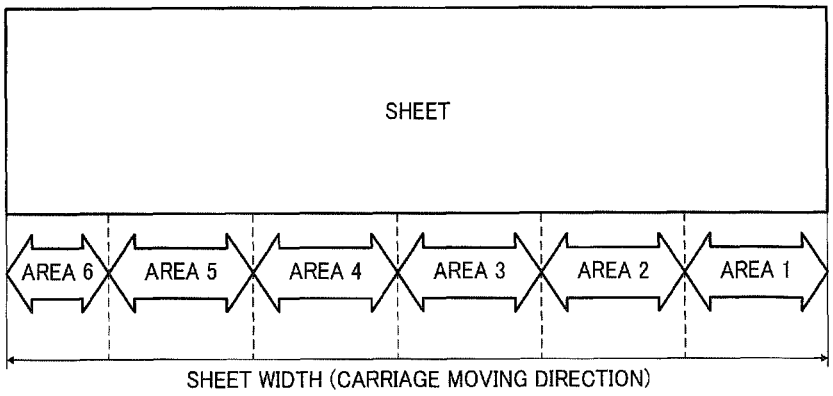
FIG. 27 is a schematic view of divided areas in the third exemplary embodiment.

At this time, for example, as illustrated in FIG. 27, a print region of a sheet is divided into areas, in principle, at a constant distance in the width direction of the sheet. However, if the width of the sheet cannot be divided by the width of the divided area, like a divided area 6 illustrated in FIG. 27, one area may be shorter than other areas.

Here, the summation of the liquid ejection amount is performed by soft counting. In the soft counting, the number of liquid droplets ejected from the recording head 34 to a divided area is counted for different droplet sizes, and a total droplet amount of liquid droplets ejected at each droplet size is obtained by multiplying a droplet amount of a single liquid droplet of each droplet size by the number of liquid droplets ejected at each droplet size. Then, the total droplet amounts of liquid droplets ejected at the respective droplet sizes are summed and determined as the liquid ejection amount of the divided area.

At S302 of FIG. 26, the sum of the liquid ejection amount thus calculated is written (stored) in a shared memory region of, e.g., the RAM 503.

At S303, it is determined whether printing is finished or not. If printing is finished (YES at S303), the process ends. If subsequent printing is requested (NO at S303), the process returns to S301 to print the next divided area and sum up the liquid ejection amount of the next divided area.

In the calculation of the liquid consumption amount illustrated in (b) of FIG. 26, first, it is determined whether new summation data of liquid ejection amounts of divided areas is stored in the shared memory region. If new summation data is stored in the shared memory region, at S401 the summation data of liquid ejection amounts of divided areas is red from the shared memory region and added to the liquid consumption amount of the sub tank at S402.

In FIG. 26, the calculation of the liquid ejection amount and the calculation of the liquid remaining amount are performed by separate routines. In such a case, data may be transmitted via communication instead of the shared memory region.

Figure 28:
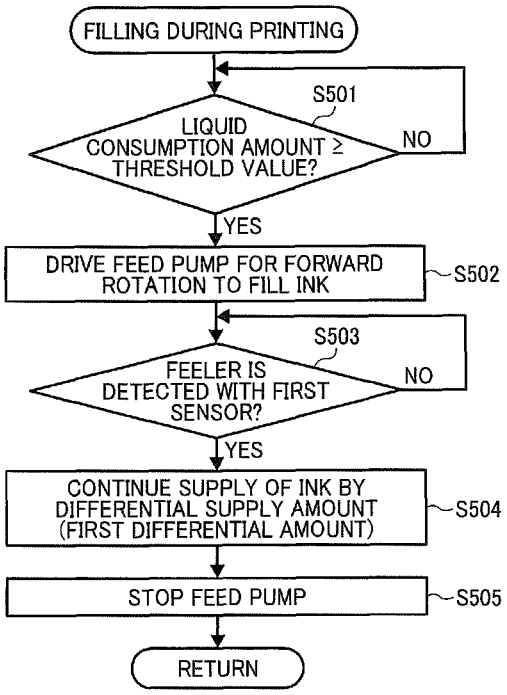
FIG. 28 is a flowchart showing a procedure of ink filling during printing (supply control) in the third exemplary embodiment.

Next, ink filling (supply control) performed during printing in this exemplary embodiment is described with reference to FIG. 28.

During printing, at S501, it is determined whether or not the liquid consumption amount of the sub tank 35 obtained as described above is greater than a predetermined threshold value. If the liquid consumption amount of the sub tank 35 is greater than the predetermined threshold value (YES at S501), at S502 the liquid feed pump 241 is driven for forward rotation to fill ink from the main tank 10 to the sub tank 35. At S503, it is determined whether or not the first sensor 251 detects the displacement member (feeler) 205 of the sub tank 35. If the first sensor 251 detects the displacement member 205 of the sub tank 35 (YES at S503), at S504 ink is further filled to the sub tank 35 by the differential supply amount. As a result, ink is filled up to the ink full position in the sub tank 35.

Thus, during printing, ink can be filled up to the ink full position in the sub tank 35 without returning the carriage 33 to the home position.

Then, as described above, the liquid ejection amounts are summed up at summation timings set by dividing a moving distance or time of the carriage in a single direction. The sum of the liquid ejection amounts is added to the liquid consumption amount of the sub tank. In supplying liquid from the main tank to the sub tank without using the second detector (sensor), when the liquid consumption amount in the sub tank exceeds a threshold value, liquid feeding is started. Such a configuration can supply liquid to the sub tank at a proper timing without increasing the capacity of the sub tank.

In such a case, relations of $Vt \geq Vs$ and $Vs/2 > Vb$ can be satisfied where Vs represents a threshold value of the liquid consumption amount at which ink filling to the sub tank 35 is started, Vt represents a threshold value of the liquid consumption amount that is a limit value of a range of liquid consumption amounts in which ink in the sub tank 35 can be normally ejected, and Vb represents a liquid consumption amount required for solid printing of a divided area (i.e., printing an entire surface of a divided area or printing the divided area at a maximum ejection amount of the recording head).

Such a configuration can maintain the maximum amount of ink consumed at the divided areas below half of the threshold value Vt, i.e., the limit value of the liquid consumption amount of the sub tank 35. As a result, before the liquid consumption amount of the sub tank 35 exceeds the threshold value Vt of normal ejection, ink filling to the sub tank 35 can be started, thus preventing ejection failure that might be caused by overuse of ink in the sub tank 35.

Next, a fourth exemplary embodiment of the present disclosure is described with reference to FIG. 29.

Figure 29:
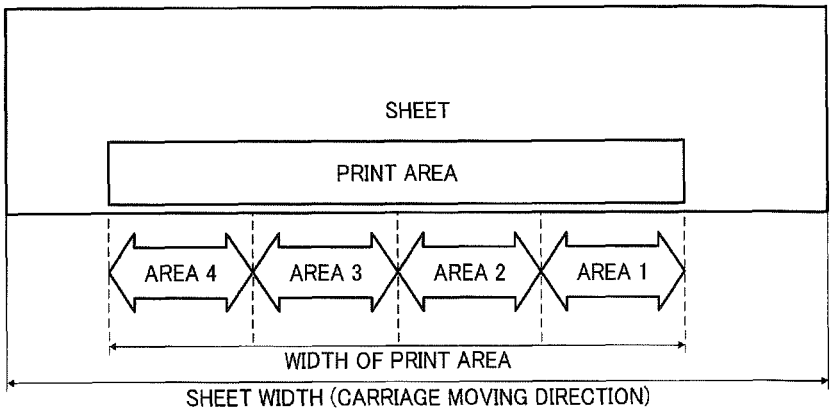
FIG. 29 is a schematic view of divided areas in a fourth exemplary embodiment.

FIG. 29 shows divided areas in the fourth exemplary embodiment.

In FIG. 29, a print region of a sheet is divided into areas based on the width of the print region, instead of the width of the sheet. The width of the print region may be, e.g., a maximum printable range of the sheet or a region including print data in the maximum printable range.

Such definition of the divided areas to determine timings for summing up the liquid ejection amount can reduce the number of divided areas and process only an actually printed range, thus preventing waste of computation.

Next, a fifth exemplary embodiment of the present disclosure is described with reference to FIG. 30.

Figure 30:
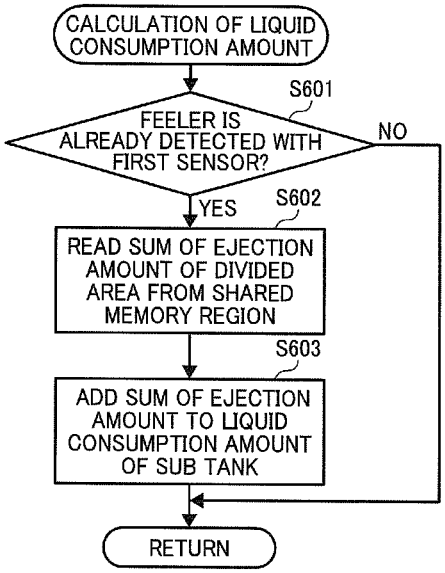
FIG. 30 is a flowchart showing a procedure of calculation of the remaining amount of liquid (ink) in a fifth exemplary embodiment.

FIG. 30 shows a procedure of calculation of the remaining amount of liquid (ink) in the fifth exemplary embodiment.

In this exemplary embodiment, at S601 it is determined whether or not the first sensor 251 detects the displacement member (feeler) 205. If the first sensor 251 detects the displacement member (feeler) 205 (YES at S601), at S602 the sum of the liquid ejection amounts of divided areas is read from a shared memory region. At 603, the sum of the liquid ejection amounts is added to the liquid consumption amount of the sub tank.

Such a configuration can minimize influence that might be caused by errors in the soft counting, such as miscounting of non-ejected droplets due to, e.g., nozzle clogging.

Hence, in this exemplary embodiment, after the displacement member 205 serving as a physical detection unit of the ink consumption amount is detected with the first sensor 251, counting of the ink ejection amount is started. Such a configuration can reduce the influence caused by errors, as compared to a case in which the ink ejection amount of all divided areas is counted by the soft counting.

Next, a sixth exemplary embodiment of the present disclosure is described with reference to FIG. 31.

Figure 31:
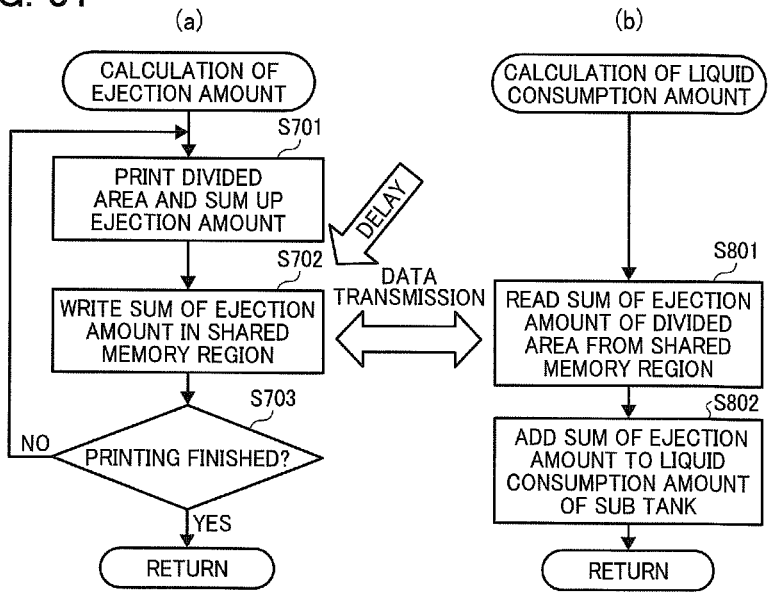
FIG. 31 shows flowcharts of calculation of the liquid ejection amount and calculation of the liquid consumption amount in a sixth exemplary embodiment.

FIG. 31 shows (a) a procedure of calculation of the liquid ejection amount and (b) a procedure of calculation of the liquid consumption amount in the sixth exemplary embodiment.

In the above-described third exemplary embodiment, for example, a delay in the calculation of the liquid ejection amount may cause a delay in the data writing to the shared memory region.

Hence, in this exemplary embodiment, in a case in which, after a predetermined threshold time or a time during which the carriage moves a predetermined distance has elapsed, data on the liquid ejection amount of an immediately-preceding divided area cannot be obtained, in other words, the liquid consumption amount in the sub tank 35 is not summed up, ink filling to the sub tank 35 is started if the liquid consumption amount V in the sub tank 35 satisfies a relation of $V+Vb \geq Vt$. As described above, Vt represents a threshold value of liquid consumption amount that is a limit value of a range of liquid consumption amounts in which ink in the sub tank 35 can be normally ejected, and Vb represents a liquid consumption amount required for solid printing of a divided area (i.e., printing an entire surface of a divided area or printing the divided area at a maximum ejection amount of the recording head).

In other words, in a case in which the liquid ejection amount of the immediately-preceding divided area is not reflected to the liquid consumption amount in the sub tank 35 and the sum of the liquid consumption amount Vb required when the immediately-preceding divided area is solidly printed and the liquid consumption amount V of the sub tank 35 might exceed the threshold value Vt of the liquid ejection amount of the sub tank, ink filling to the sub tank 35 is started on assumption that the liquid consumption amount in the sub tank 35 might exceed the threshold value.

Such a configuration can maintain the negative pressure of the sub tank within a normal use range, thus preventing excessive negative pressure due to overuse of ink in the sub tank and securing normal droplet ejection of the recording head.

The reference point of the predetermined threshold time may be, e.g., an elapsed time from the update of data on the liquid ejection amount of the preceding divided area, and the threshold value may be, e.g., a sum of a time during the carriage moves across a single divided area and a computation time.

Various types of control (processing) for supplying ink to the sub tank are performed by a computer storing a program in, e.g., the ROM 502. The program can be downloaded into the information processing device (host 600) and installed to the image forming apparatus. For example, the image forming apparatus according to any exemplary embodiment of this disclosure may be combined with an information processing device to form an image forming system. Alternatively, an image forming apparatus may be combined with an information processing device including the program for the control (processing) according to any exemplary embodiment of this disclosure.

Image forming apparatuses employing liquid ejection recording methods fall into two main types: serial-type image forming apparatuses that form images by ejecting droplets from a recording head while moving the recording head in a main scanning direction, and line-head-type image forming apparatuses that form images by ejecting droplets from a linear-shaped recording head held stationary in the image forming apparatus. In the above-described exemplary embodiments of this disclosure, the image forming apparatus is described as a serial-type inkjet recording apparatus. It is to be noted that the image forming apparatus is not limited to such a serial-type inkjet recording apparatus and may be a line-head-type or any other type image forming apparatus.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus comprising:

an apparatus body;

a recording head to eject droplets of liquid;

a sub tank to store the liquid supplied to the recording head;

a carriage mounting the recording head and the sub tank;

a main tank to store the liquid supplied to the sub tank;

a liquid feed unit to supply the liquid from the main tank to the sub tank;

a displacement member disposed at the sub tank to displace with a remaining amount of the liquid in the sub tank;

a first detector disposed at the carriage to detect the displacement member;

a second detector disposed at the apparatus body to detect the displacement member;

a first calculation unit to detect and retain a first difference between a first-detector detection position of the displacement member at which the displacement member is detected by the first detector and a liquid full position of the displacement member at which the displacement member is detected by the second detector;

a second calculation unit to calculate and retain a second difference between the first-detector detection position of the displacement member and a supply start position of the displacement member at which the liquid feed unit starts the liquid from the main tank to the sub tank;

a third calculation unit to calculate, from image data to be printed, and retain a relation between main scanning position of the carriage and consumption amount of the liquid ejected from the recording head to print the image data;

a determination unit to, when the first detector detects the displacement member, determine a main scanning position of the carriage at which the consumption amount of the liquid ejected from the recording head to print the image data is equal to a liquid consumption amount corresponding to the second difference, based on the relation retained by the third calculation unit; and a supply control unit to cause the liquid feed unit to start supply of the liquid from the main tank to the sub tank when the carriage arrives at the main scanning position determined by the determination unit during printing of the image data, and stop the supply of the liquid when the liquid is supplied at a supply amount corresponding to the first difference after the first detector detects the displacement member.

2. The image forming apparatus of claim 1, wherein the relation is calculated from main scanning positions of the carriage and consumption amounts of the liquid ejected from the recording head to print the image data obtained per certain main scanning distance or per each of divided areas in a page, and the supply control unit causes the liquid feed unit to start the supply of the liquid from the main tank to the sub tank when, during printing of the image data, the carriage arrives at an area preceding, by one or two, an area in which the consumption amount of the liquid ejected from the recording head during printing of the image data exceeds the liquid consumption amount corresponding to the second difference.

3. The image forming apparatus of claim 2, wherein the areas in the page are divided by using, as a reference position, an image formation start position or an edge position of a recording medium on which the image data is printed.

4. An image forming apparatus comprising:

an apparatus body;

a recording head to eject droplets of liquid;

a sub tank to store the liquid supplied to the recording head;

a carriage mounting the recording head and the sub tank;

a main tank to store the liquid supplied to the sub tank;

a liquid feed unit to supply the liquid from the main tank to the sub tank;

a displacement member disposed at the sub tank to displace with a remaining amount of the liquid in the sub tank;

a first detector disposed at the carriage to detect a first position of the displacement member;

a second detector disposed at the apparatus body to detect a second position of the displacement member at which the remaining amount of the liquid in the sub tank is greater than at the first position of the displacement member; and a supply control unit to detect and retain a differential supply amount of the liquid corresponding to a displacement amount of the displacement member between the first position detected by the first detector and the second position detected by the second detector and to, when the liquid is supplied from the main tank to the sub tank without using the second detector, cause the liquid feed unit to supply the liquid to the sub tank at the differential supply amount after the first detector detects the displacement member, the supply control unit including a liquid ejection amount calculator to sum up ejection amount of the liquid ejected from the sub tank, and a liquid consumption amount calculator to calculate a liquid consumption amount in the sub tank by adding a sum of the ejection amount of the liquid ejected from the sub tank, wherein the liquid ejection amount calculator sums up the ejection amount at summation timings set by dividing a moving distance of the carriage in a single direction or a moving time of the carriage into a plurality of distances or time periods, and when the liquid consumption amount in the sub tank exceeds a threshold value during supply of the liquid from the main tank to the sub tank without using the second detector, the supply control unit causes the liquid feed unit to start the supply of the liquid from the main tank to the sub tank.

5. The image forming apparatus of claim 4, wherein the moving distance of the carriage in the single direction or the moving time of the carriage corresponds to a width of a recording media on which an image is formed by the recording head.

6. The image forming apparatus of claim 4, wherein the moving distance of the carriage in the single direction or the moving time of the carriage corresponds to a maximum printable region of a recording medium on which an image is formed by the recording head.

7. The image forming apparatus of claim 4, wherein the moving distance of the carriage in the single direction or the moving time of the carriage corresponds to a region on which an image is formed by the recording head.

8. The image forming apparatus of claim 4, wherein relations of $Vt \geq Vs$ and $Vs/2 > Vb$ are satisfied where Vs represents a first threshold value of the liquid consumption amount in the sub tank at which the supply of the liquid from the main tank to the sub tank is started, Vt represents a second threshold value of the liquid consumption amount in the sub tank that is a limit value of a range of the liquid consumption amount in which the liquid in the sub tank can be normally ejected, and Vb represents a consumption amount of the liquid ejected from the recording head to print an entire surface of one of the divided areas.

9. The image forming apparatus of claim 4, wherein, after the first detector detects the displacement member, the liquid consumption amount calculator calculates the liquid consumption amount in the sub tank.

10. The image forming apparatus of claim 4, wherein the supply control unit causes the liquid feed unit to start the supply of the liquid from the main tank to the sub tank when the liquid consumption amount in the sub tank does not change after elapse of a predetermined threshold time or a time required for the carriage to move a predetermined distance and a relation of $V+Vb \geq Vt$ is satisfied where V represents the liquid consumption amount in the sub tank, Vt represents a threshold value of the liquid consumption amount in the sub tank that is a limit value of a range of the liquid consumption amount in which the liquid in the sub tank can be normally ejected, and Vb represents a consumption amount of the liquid ejected from the recording head to print an entire surface of one of the divided areas.

* * * * *